US008743010B2

(12) United States Patent
Yanagi et al.

(10) Patent No.: US 8,743,010 B2
(45) Date of Patent: Jun. 3, 2014

(54) ANTENNA DEVICE

(75) Inventors: Masahiro Yanagi, Tokyo (JP); Shigemi Kurashima, Tokyo (JP); Hideaki Yoda, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 397 days.

(21) Appl. No.: 12/956,048

(22) Filed: Nov. 30, 2010

(65) Prior Publication Data

US 2011/0205138 A1 Aug. 25, 2011

(30) Foreign Application Priority Data

Feb. 25, 2010 (JP) ..... 2010-039657

(51) Int. Cl.

| | |
|---|---|
| ***H01Q 1/48*** | (2006.01) |
| ***H01Q 9/42*** | (2006.01) |
| ***H01Q 1/24*** | (2006.01) |
| ***H01Q 1/04*** | (2006.01) |

(52) U.S. Cl.
USPC ..... 343/845

(58) Field of Classification Search
USPC ..... 343/845, 701, 866, 702, 906, 700 MS
See application file for complete search history.

(56) References Cited

U.S. PATENT DOCUMENTS

| | | | | |
|---|---|---|---|---|
| 6,670,925 | B2 | 12/2003 | Iwai et al. | |
| 6,946,994 | B2 * | 9/2005 | Imaizumi et al. | 343/702 |
| 7,026,999 | B2 | 4/2006 | Umehara et al. | |
| 7,242,356 | B2 * | 7/2007 | Lu et al. | 343/702 |
| 7,602,343 | B2 | 10/2009 | Takada et al. | |
| 7,777,677 | B2 | 8/2010 | Bungo et al. | |
| 7,859,471 | B2 | 12/2010 | Bungo et al. | |
| 7,990,320 | B2 * | 8/2011 | Pros et al. | 343/700 MS |
| 8,111,200 | B2 | 2/2012 | Yagi et al. | |
| 8,212,731 | B2 | 7/2012 | Bungo et al. | |
| 2004/0263400 | A1 * | 12/2004 | Yuanzhu | 343/702 |

(Continued)

FOREIGN PATENT DOCUMENTS

| | | |
|---|---|---|
| JP | 2001-168629 | 6/2001 |
| JP | 2003-051712 | 2/2003 |

(Continued)

OTHER PUBLICATIONS

Heidari et al. "A Dual-Band Circularly Polarized Stub Loaded Microstrip Patch Antenna for GPS Applications", Progress in Electromagnetics Research, PIER 92, 195-208, 2009.*

(Continued)

*Primary Examiner* — Huedung Mancuso
(74) *Attorney, Agent, or Firm* — IPUSA, PLLC

(57) ABSTRACT

An antenna device includes a T-shaped element having a first end part, a second end part, and a third end part, the first end part being a feeding point, the T-shaped element being bifurcated at an intermediate point; and a stub having one end connected between the intermediate point and the second end point and another end connected to ground, the stub forming a π-shaped configuration with the T-shaped element; wherein a length of a first line between the first end part and the second end part is longer than a length of a second line between the first end part and the third end part; and the length of the first line and the length of the second line correspond to a first resonance frequency and a second resonance frequency.

11 Claims, 15 Drawing Sheets

(56) References Cited

U.S. PATENT DOCUMENTS

| | | | | |
|---|---|---|---|---|
| 2009/0146906 | A1* | 6/2009 | Anguera Pros et al. | 343/906 |
| 2010/0123635 | A1* | 5/2010 | Lopez et al. | 343/722 |
| 2010/0214181 | A1* | 8/2010 | Ryou et al. | 343/702 |
| 2012/0319918 | A1* | 12/2012 | Ramachandran et al. | 343/852 |
| 2013/0002494 | A1* | 1/2013 | Ayala et al. | 343/702 |

FOREIGN PATENT DOCUMENTS

| | | |
|---|---|---|
| JP | 2004-048471 | 2/2004 |
| JP | 2004-201278 | 7/2004 |
| JP | 2005-295493 | 10/2005 |
| JP | 2008-124617 | 5/2008 |
| JP | 2009-290522 | 12/2009 |
| WO | WO 2005/048404 | 5/2005 |

OTHER PUBLICATIONS

Daniel et al., "Tunable Dual and Triple Frequency Stub Loaded Rectangular Microstrip Antennas", IEEE, pp. 2140-2143, 1995.*

Lee et al., "A Novel UWB Antenna Using PI-Shaped Matching Stub for UWB Applications", Proceedings of the 2008 IEEE International Conference on Ultra-Wideband (ICUWB2008), vol. 1, 2008, pp. 109-112.*

"Stub (electronics)"—Wikipedia—http://en.wikipedia.org/wiki/Stub_(electronics).*

* cited by examiner

ANTENNA DEVICE

CROSS-REFERENCE TO RELATED APPLICATIONS

This patent application is based upon and claims the benefit of priority of Japanese Patent Application No. 2010-039657 filed on Feb. 25, 2010, the entire contents of which are incorporated herein by reference.

BACKGROUND OF THE INVENTION

1. Field of the Invention

The present invention generally relates to antenna devices.

2. Description of the Related Art

An antenna device whereby high capacity communications can be performed is used for, for example, Bluetooth (registered trademark) at 2.4 GHz band standardized as IEEE 802.15, wireless LAN (Local Area Network) at 2.4 GHz band standardized as IEEE 802.11b or IEEE 802.11g, wireless LAN (Local Area Network) at 5 GHz band standardized as IEEE 802.11a, or the like.

In addition, antenna devices having plural resonance frequencies, accompanied with diversification of service conditions or the like, have been suggested. See, for example, Japanese Laid-Open Patent Application Publication No. 2004-201278 and Japanese Laid-Open Patent Application Publication No. 2008-124617.

In the meantime, in the antenna devices having plural resonance frequencies, it is relatively difficult to make adjustments for achieving good characteristics at each of the resonance frequencies.

SUMMARY OF THE INVENTION

Accordingly, embodiments of the present invention may provide a novel and useful antenna device solving one or more of the problems discussed above.

More specifically, the embodiments of the present invention may provide an antenna device whereby plural resonance frequencies can be easily adjusted.

Another aspect of the embodiments of the present invention may be to provide an antenna device, including a T-shaped element having a first end part, a second end part, and a third end part, the first end part being a feeding point, the T-shaped element being bifurcated at an intermediate point; and a stub having one end connected between the intermediate point and the second end point and another end connected to ground, the stub forming a π-shaped configuration with the T-shaped element; wherein a length of a first line between the first end part and the second end part is longer than a length of a second line between the first end part and the third end part; and the length of the first line and the length of the second line correspond to a first resonance frequency and a second resonance frequency.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 18 of embodiments of the present invention.

First Embodiment

Figure 1:
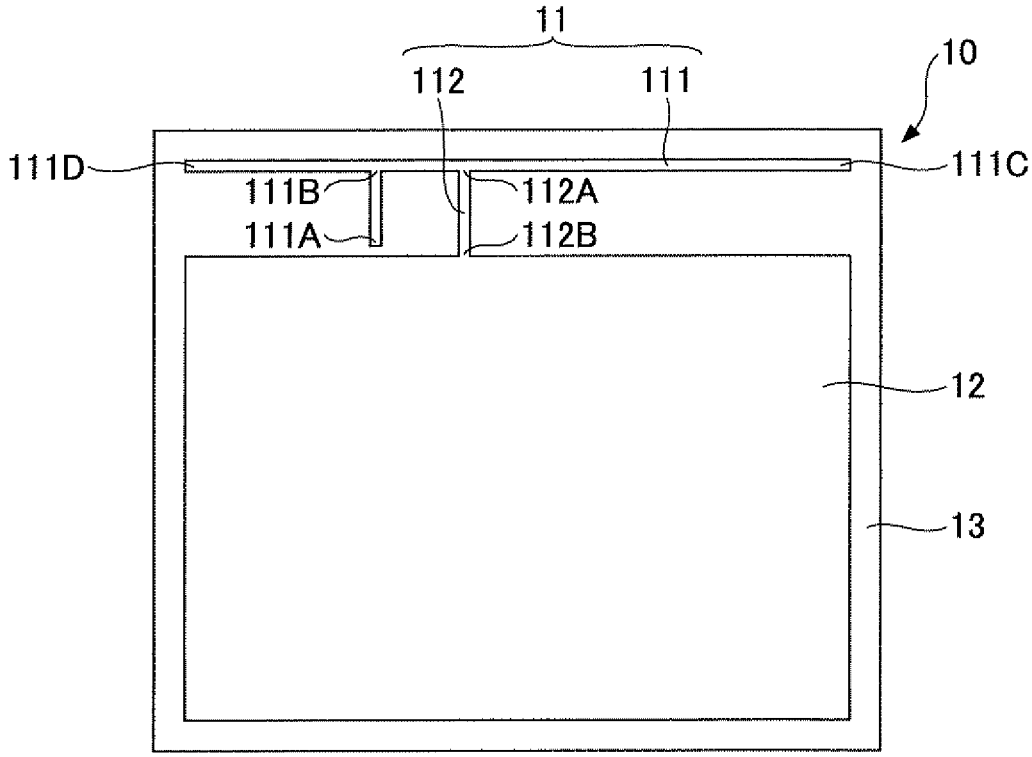
FIG. 1 is a plan view showing an antenna device 10 of a first embodiment of the present invention.
Figure 2:
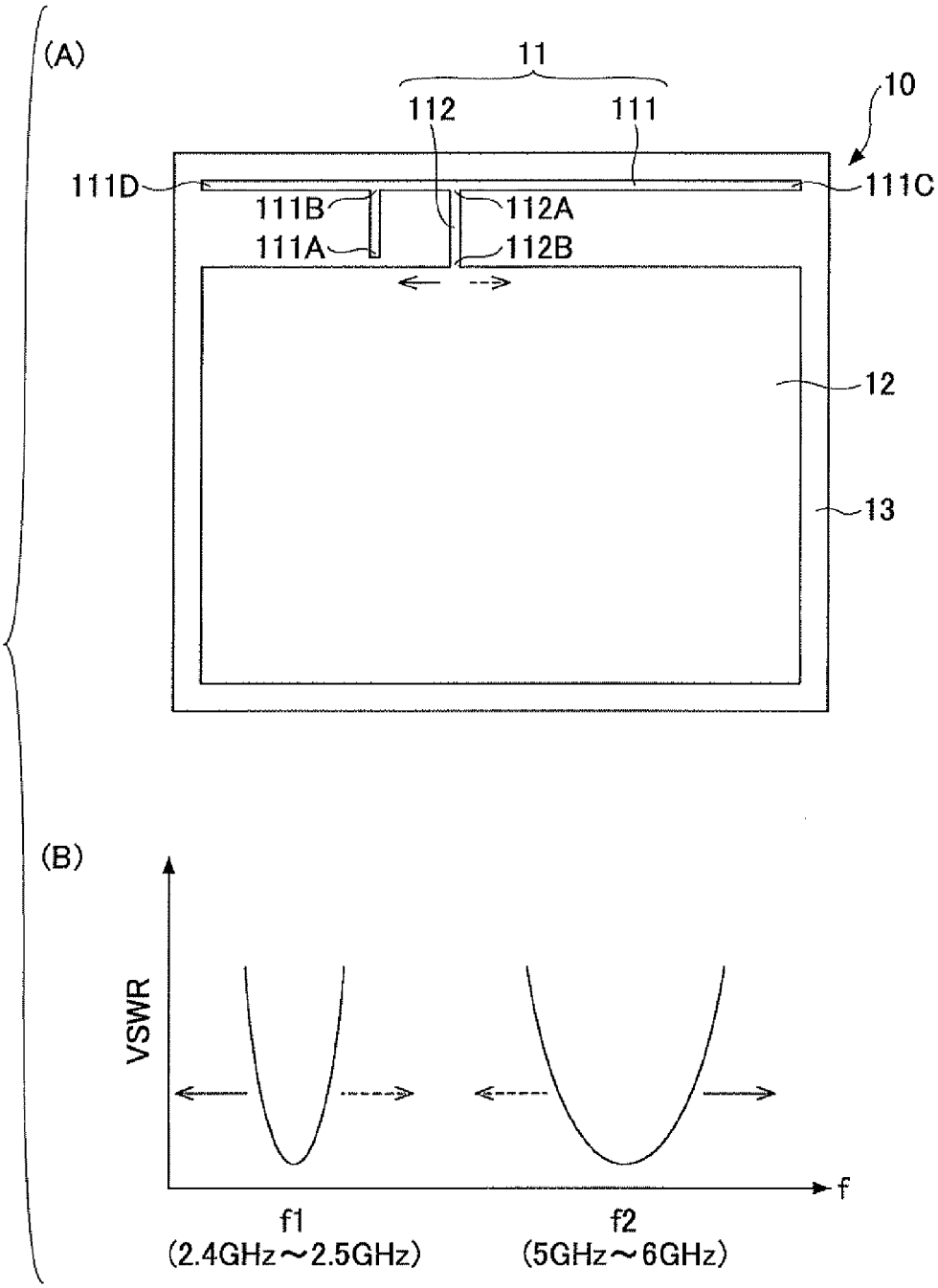
FIG. 2 is a view for explaining a method for adjusting resonance frequencies of the antenna device 10 of the first embodiment.
Figure 3:
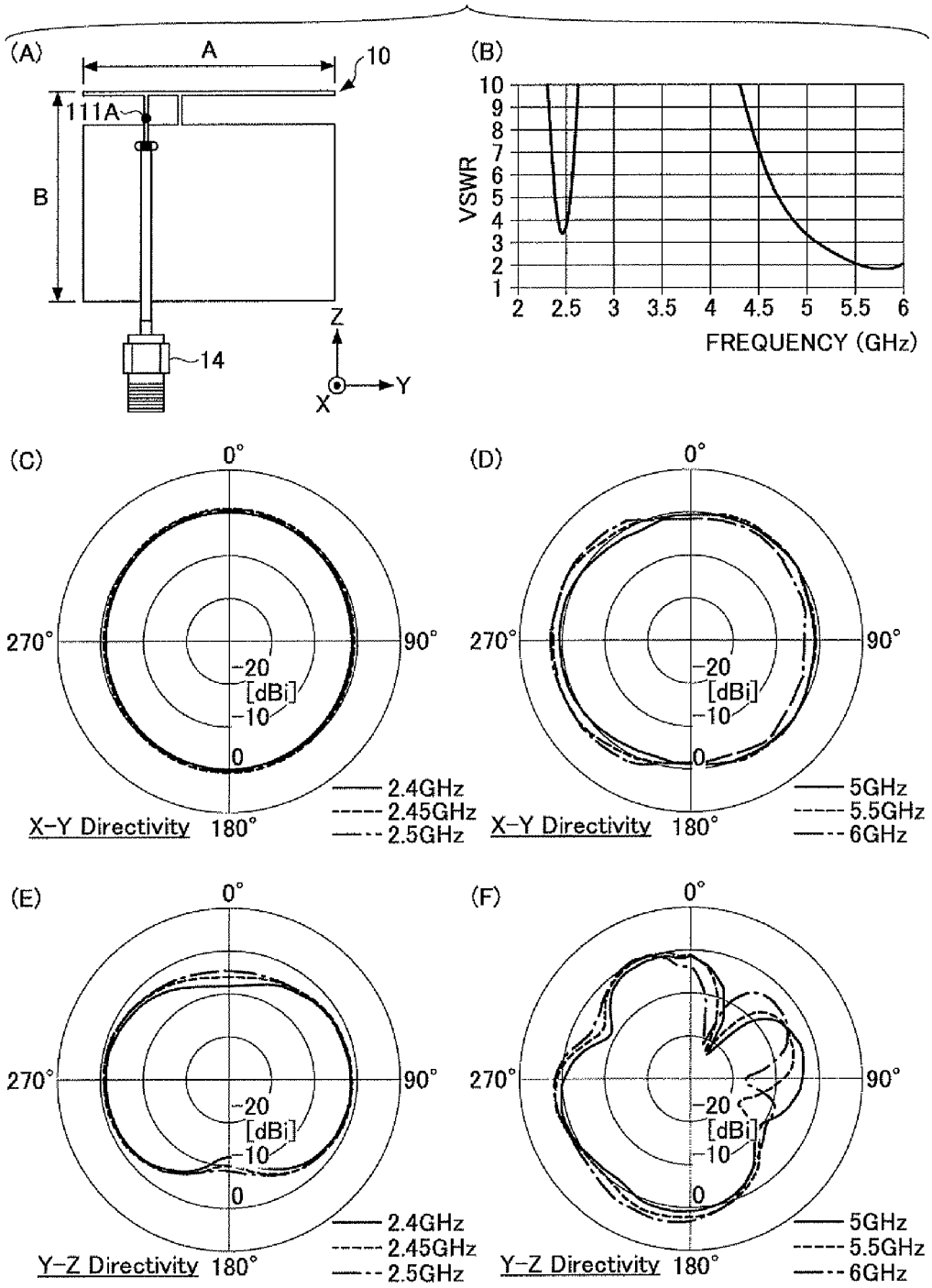
FIG. 3 is a view showing characteristics of the antenna device 10 of the first embodiment.

FIG. 1 is a plan view showing an antenna device 10 of a first embodiment of the present invention.

The antenna device 10 of the first embodiment includes an antenna element 11 and a ground element 12. The antenna element 11 and the ground element 12 are a plane plate-shaped member formed on the same surface on a board 13 and made of, for example, copper foil. The board 13 may be, for example, a glass epoxy board (FR4 board).

The antenna element 11 includes a T-shaped element 111 and a stub 112. The T-shaped element 111 and the stub 112 form a π-shaped configuration.

The element 111 includes a first end part 111A which is a feeding point, a second end part 111C, and a third end part 111D. The element 111 is branched and has a T-shaped configuration.

An end 112A of the stub 112 is connected between an intermediate point 111B and the second end part 1110 of the element 111. Another end 112B of the stub 112 is connected to the ground element 12, so that the stub 112 is grounded.

The stub 112 is formed in parallel with a line between the first end part 111A and the intermediate point 111B of the antenna element 11.

The antenna element 11 has a structure where a Planar Inverted F Antenna (PIFA) element formed by the first end part 111A, the intermediate point 111B, the third end part 111D, the end 112A, and the end 112B and a Planar Inverted F Antenna (PIFA) element formed by the first end part 111A, the intermediate point 111B, the second end part 1110, the end 112A, and the end 112B are combined.

A length from the first end part 111A to the second end part 1110 is longer than a length from the first end part 111A to the third end part 111D. The length from the first end part 111A to the second end part 111C is determined based on a first resonance frequency f1. The length from the first end part 111A to the third end part 111D is determined based on a second resonance frequency f2 (f2>f1). Here, the first resonance frequency f1 is in a range between approximately 2.4 GHz and approximately 2.5 GHz. The second resonance frequency f1 is in a range between approximately 5.0 GHz and approximately 6.0 GHz.

The antenna element 11 illustrated in FIG. 1 is formed so that a length from the second end part 111C to the third end part 111D is substantially equal to a width of the ground element 12.

Next, a method for adjusting resonance frequencies of the antenna device 10 of the first embodiment is discussed with reference to FIGS. 2(A)-2(B).

FIG. 2(A) is a view for explaining the method for adjusting resonance frequencies of the antenna device 10 of the first embodiment.

In the antenna device 10 of the first embodiment, it is possible to adjust the first resonance frequency f1 and the second resonance frequency f2 by changing a position where the stub 112 is connected to the element 111.

By moving the stub 112 toward a line between the first end part 111A and the intermediate point 111B as illustrated by a solid-line arrow in FIG. 2(A), a band including the first resonance frequency f1 is shifted to a low frequency side and a band including the second resonance frequency f2 is shifted to a high frequency side.

By further separating the stub 112 from the line between the first end part 111A and the intermediate point 111B as illustrated by a dotted-line arrow in FIG. 2(A), a band including the first resonance frequency f1 is shifted to the high frequency side and a band including the second resonance frequency f2 is shifted to the low frequency side.

The first resonance frequency f1 is in a range between approximately 2.4 GHz and approximately 2.5 GHz. The second resonance frequency f2 is in a range between approximately 5.0 GHz and approximately 6.0 GHz. As shown in FIG. 2(B), a VSWR (Voltage Standing Wave Ratio) of the first resonance frequency f1 is a minimum in a band range between approximately 2.4 GHz and approximately 2.5 GHz. A VSWR of the second resonance frequency f2 is a minimum in a band range between approximately 5.0 GHz and approximately 6.0 GHz.

If the antenna device 10 does not include the stub 112, the first resonance frequency f1 and the second resonance frequency f2 are adjusted by adjusting a length of the line between the first end part 111A and the intermediate point 111B, a length of the line between the intermediate point 111E and the second end part 111C, and a length of the line between the intermediate point 111E and the third end point 111D.

When the length of the line between the first end part 111A and the intermediate point 111E is adjusted, both the first resonance frequency f1 and the second resonance frequency f2 are changed. When the length of the line between the intermediate point 111B and the second end part 111C is adjusted, not only the first resonance frequency f1 but also the second resonance frequency f2 is changed. In addition, when the length of the line between the intermediate point 111B and the third end part 111D is adjusted, not only the second resonance frequency f2 but also the first resonance frequency f1 is changed.

Because of this, in the antenna device not including the stub 112, it is difficult to adjust the first resonance frequency f1 and the second resonance frequency f2.

On the other hand, in the antenna device 10 of the first embodiment, it is possible to adjust the first resonance frequency f1 and the second resonance frequency f2 by changing the position where the stub 112 is connected to the element 111 and the ground element 12. In addition, since the stub 112 is provided, even if the length of the line between the intermediate point 111B and the second end part 111C is changed, the second resonance frequency f2 is not much influenced. Similarly, since the stub 112 is provided, even if the length of the line between the intermediate point 111B and the third end part 111D is changed, the first resonance frequency f1 is not much influenced. This is because the end 112B of the stub 112 is connected to the ground element 12.

Because of this, in the antenna device 10 of the first embodiment compared to the antenna device not including the stub 112, it is possible to easily adjust the first resonance frequency f1 and the second resonance frequency f2.

Next, characteristics of the antenna device 10 of the first embodiment are discussed with reference to FIGS. 3(A)-3(F).

FIGS. 3(A)-3(F) show the characteristics of the antenna device 10 of the first embodiment.

As illustrated in FIG. 3(A), a length A between the second end part 111C and the third end part 111D of the antenna element 11 is approximately 36 mm. A length B between the antenna element 11 and an end part of the ground element 12 is approximately 30 mm.

As illustrated in FIG. 3(A), in the antenna device 10 having the above-mentioned size, a core line of a coaxial cable 14 is connected to the first end part 111A which is a feeding point. A shield line of the coaxial cable 14 is connected to the ground element in the vicinity of the first end part 111A. Under this structure, characteristics of VSWR (Voltage Standing Wave Ratio) illustrated in FIG. 3(B) are measured. An X-axis, a Y-axis, and a Z-axis are set as illustrated in FIG. 3(A). Furthermore, directivities (far-field radiation characteristics) illustrated in FIG. 3(C) through FIG. 3(F) are measured by simulation based on a finite element method.

As illustrated in FIG. 3(B), approximately 3.5 as the VSWR is obtained between approximately 2.4 GHz and approximately 2.5 GHz. Approximately 1.8 through 3.0 as the VSWR is obtained between approximately 5.0 GHz and approximately 6.0 GHz. These values indicate that reflection is little. It is found that the antenna device 10 is proper for high capacity communications between approximately 2.4 GHz and approximately 2.5 GHz and for high capacity communications at approximately 5.0 GHz.

As illustrated in FIG. 3(C), as the directivity at an X-Y surface, a value of approximately 0 dBi is substantially equivalently provided in each case of approximately 2.4 GHz, approximately 2.45 GHz, and approximately 2.5 GHz. Therefore, it is found that directivities at an X-Y surface at approximately 2.4 GHz, approximately 2.45 GHz, and approximately 2.5 GHz are good.

As illustrated in FIG. 3(D), as the directivity at an X-Y surface, a value of approximately −5 dBi through approximately 0 dBi is substantially equivalently provided in each case of approximately 5.0 GHz, approximately 5.5 GHz, and approximately 6.0 GHz. Therefore, it is found that directivities at an X-Y surface at approximately 5.0 GHz through approximately 6.0 GHz are good.

As illustrated in FIG. 3(E), as the directivity at a Y-Z surface, a value of approximately −10 dBi through approximately 0 dBi is substantially equivalently provided in each case of approximately 2.4 GHz, approximately 2.45 GHz, and approximately 2.5 GHz, excluding the vicinities of 0 degrees being a null point and 180 degrees. Therefore, it is found that directivities at a Y-Z surface at approximately 2.4 GHz through approximately 2.5 GHz are good.

As illustrated in FIG. 3(F), as the directivity at a Y-Z surface, a value of approximately −15 dBi through approximately 0 dBi is provided in each case of approximately 5.0 GHz, approximately 5.5 GHz, and approximately 6.0 GHz. Therefore, it is found that directivities at a Y-Z surface at approximately 5.0 GHz through approximately 6.0 GHz are relatively good.

As discussed above, it is found that three-dimensionally good directivities are obtained in two frequency bands, namely approximately 2.4 GHz through approximately 2.5 GHz and approximately 5.0 GHz through approximately 6.0 GHz.

According to the first embodiment, it is possible to provide the antenna device 10 which can perform good communication at two frequency bands, namely approximately 2.4 GHz through approximately 2.5 GHz including the first resonance frequency f1 and approximately 5.0 GHz through approximately 6.0 GHz including the second resonance frequency f2.

Second Embodiment

Figure 4:
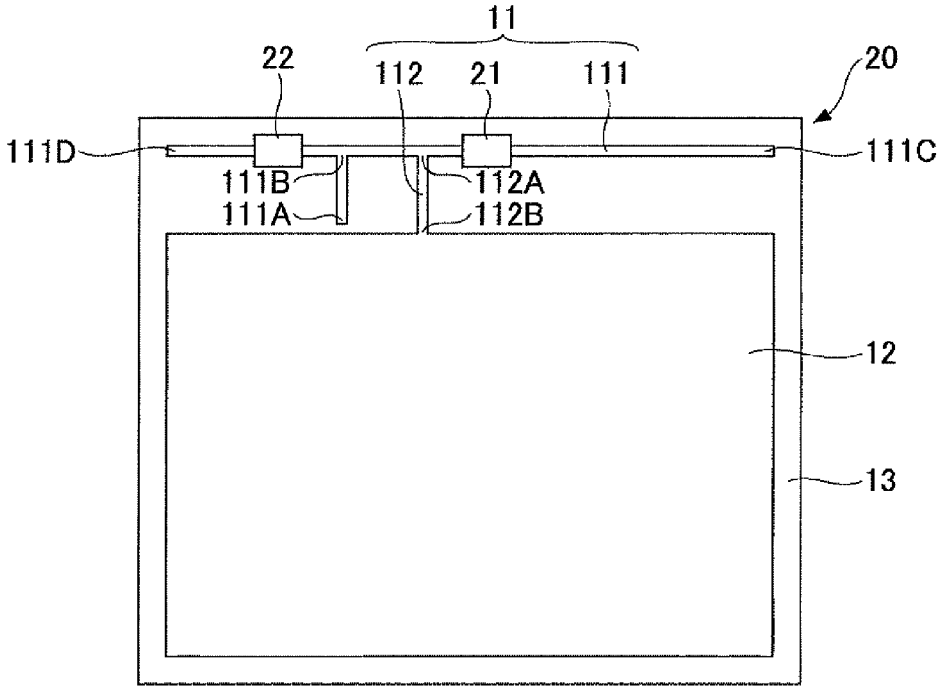
FIG. 4 is a view showing characteristics of an antenna device 20 of a second embodiment.

FIG. 4 is a view showing characteristics of an antenna device 20 of a second embodiment.

The antenna device 20 of the second embodiment is different from the antenna device 10 of the first embodiment in that in the antenna device 20, a first inductor 21 is inserted in a line between the end 112A of the stub 112 and the second end part 111C of the antenna element 11; and a second inductor 22 is inserted in a line between the intermediate point 111B and the third end part 111D of the antennal element 11. The first inductor 21 is configured to adjust the first resonance frequency f1. The second inductor 22 is configured to adjust the second resonance frequency f2.

An entire size of the antenna device 20 of the second embodiment is made small by inserting the first inductor 21 and the second inductor 22.

In a structure other than the above-mentioned structure, parts that are the same as the parts of the antenna device 10 of the first embodiment are given the same reference numerals, and explanation thereof is omitted.

The first inductor 21 and the second inductor 22 are inductive elements. In a case where the resonance frequency is constant, by inserting the inductive element, it is possible to make the length of the antenna element 11 short.

In addition, in a case where the inductance of the inductive element is large, the resonance frequency is shifted to a low frequency side. In a case where inductance of the inductive element is small, the resonance frequency is shifted to a high frequency side.

Thus, by inserting the first inductor 21 and the second inductor 22 so that each of the inductances is adjusted, it is possible to easily adjust the first resonance frequency f1 and the second first resonance frequency f2 and miniaturize the antenna device 20.

As discussed above, according to the second embodiment, it is possible to provide the antenna device 10 which can perform good communication at two frequency bands, namely approximately 2.4 GHz through approximately 2.5 GHz including the first resonance frequency f1 and approximately 5.0 GHz through approximately 6.0 GHz including the second resonance frequency f2, and possible to make the size of the antenna 10 small.

Although the antenna device 20 where the first inductor 21 and the second inductor 22 are inserted is discussed in this embodiment, only one of the first inductor 21 and the second inductor 22 may be inserted.

Third Embodiment

Figure 5:
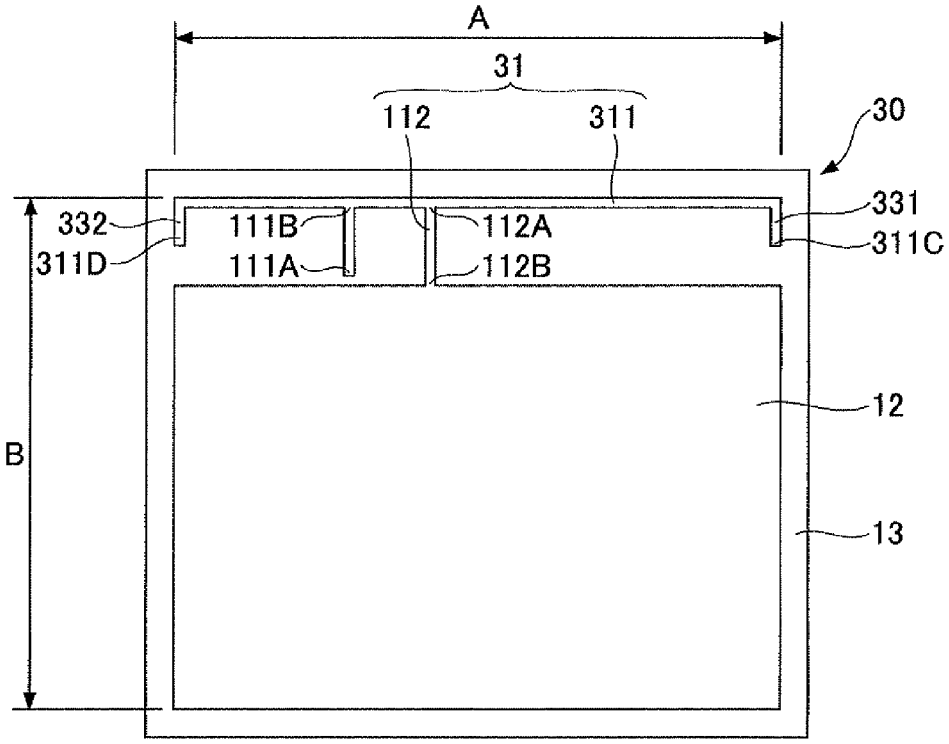
FIG. 5 is a view showing characteristics of an antenna device 30 of a third embodiment.
Figure 6:
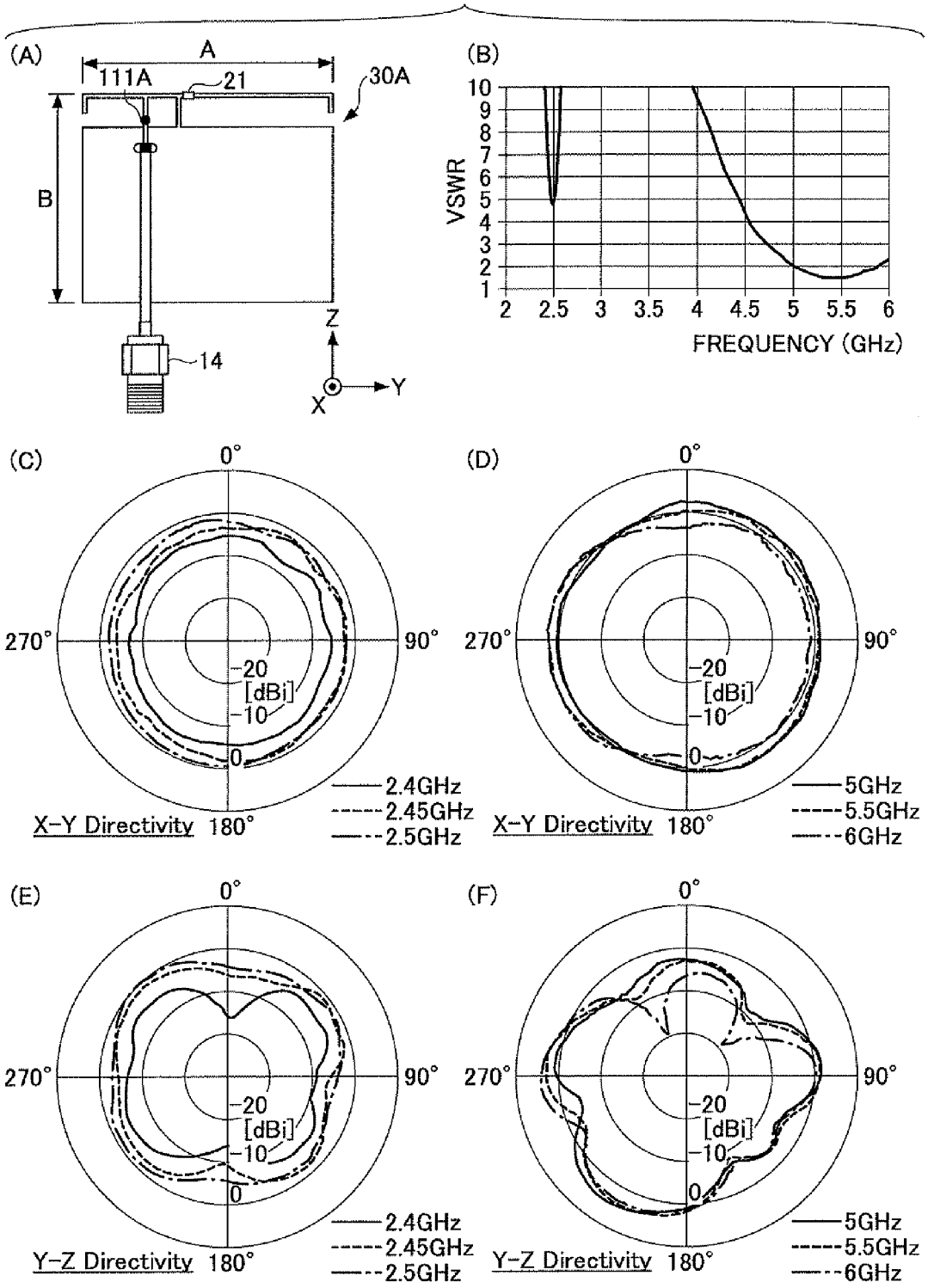
FIG. 6 is a view showing characteristics of an antenna device 30A of a modified example of the third embodiment.
Figure 7:
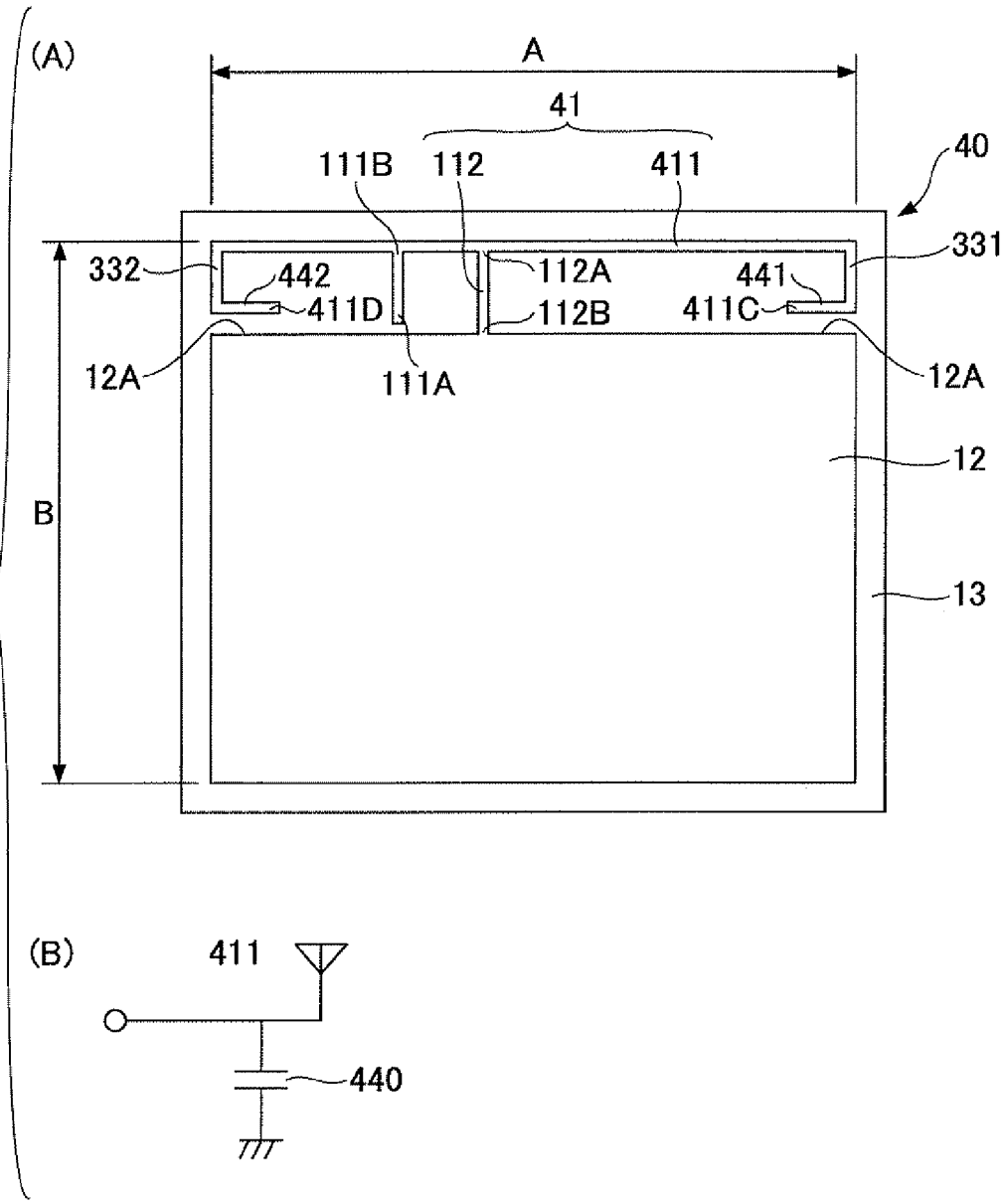
FIG. 7 is a view showing characteristics of an antenna device 40 of a fourth embodiment.

FIG. 5 is a view showing characteristics of an antenna device 30 of a third embodiment.

The antenna device 30 of the third embodiment is different from the antenna device 10 of the first embodiment in that, the antenna device 30 includes an antenna element 31 and the ground element 12, and a second end part 311C and a third end part 311D of the antenna element 31 are bent to the ground element 12 side. Since the second end part 3110 and the third end part 3110 of the antenna element 31 are bent to the ground element 12 side, it is possible to miniaturize the entire size of the antenna device.

In a structure other than the above-mentioned structure, parts that are the same as the parts of the antenna device 10 of the first embodiment are given the same reference numerals, and explanation thereof is omitted.

The antenna element 31 includes an element 311 and the stub 112.

The element 311 includes bending parts 331 and 332 formed by bending the second end part 3110 side and the third end part 311D side to the ground element 12 side. The second end part 311C is a head end of the bending part 331 and the third end part 331D is a head end of the bending part 332.

The antenna element 31 including the bending parts 331 and 332 is an example of a π-shaped antenna element.

In addition, in a case where the lengths of the bending parts 331 and 332 are long, the resonance frequency is shifted to a low frequency side. In a case where the lengths of the bending parts 331 and 332 are short, the resonance frequency is shifted to a high frequency side.

Furthermore, it is general practice that the resonance frequency is shifted to the high frequency side if the length of the line is short.

Accordingly, if the length of the line between the first end part 111A being a feeding part and the second end part 311C and the length of the line between the first end part 111A and the third end part 311D are short, and the lengths of the bending parts 331 and 332 are long, the amount of the shift of the frequency due to the short length of the line is cancelled so that the resonance frequency can be adjusted.

As discussed above, according to the antenna device 30 of the third embodiment, it is possible to adjust the first resonance frequency f1 by adjusting the length of the line between the first end part 111A being a feeding part and the second end part 3110 or the length of the bending part 331 of the second end part 311C side.

Furthermore, it is possible to adjust the second resonance frequency f2 by adjusting the length of the line between the first end part 111A being a feeding part and the third end part 311D or the length of the bending part 332 of the third end part 311D side.

In addition, it is possible to shorten a length A in a horizontal direction of the antenna device 30 by shortening the length of the line between the first end part 111A being a feeding part and the second end part 3110 or shortening the length of the line between the first end part 111A being a feeding part and the third end part 311D.

Furthermore, it is possible to shorten a length A in a horizontal direction of the antenna device 30 by forming the bending part 331 at the second end part 311C side and the bending part 332 at the third end part 311D side.

Bending the bending part 331 at the second end part 3110 side and the bending part 332 at the third end part 311D side does not cause an increase of a length B from the element 311 to the end part of the ground element 12.

However, the bending parts 331 and 332 may not be bent to the ground element 12 side. The bending parts 331 and 332 may be bent, for example, in a direction separated from the ground element 12.

Thus, according to the third embodiment, it is possible to easily adjust the first resonance frequency f1 and the second resonance frequency f2 and miniaturize the antenna device 30. In addition, it is possible to provide the antenna device which can perform good communication at two frequency bands, namely approximately 2.4 GHz through approximately 2.5 GHz including the first resonance frequency f1 and approximately 5.0 GHz through approximately 6.0 GHz including the second resonance frequency f2, and possible to make the size of the antenna device 30 small.

It is not necessary to provide both bending parts 331 and 332. Only one of the bending parts 331 and 332 may be provided. In addition, it is not necessary that the lengths of the bending parts 331 and 332 be equal to each other. The bending part 331 or 332 may be individually or optionally provided.

Next, characteristics of an antenna device 30A of a modified example of the third embodiment where the first inductor 21 of the second embodiment is added to the antenna device 30 of the third embodiment are discussed with reference to FIGS. 6(A)-6(F).

FIGS. 6(A)-6(F) are views showing characteristics of the antenna device 30A of the modified example of the third embodiment.

As illustrated in FIG. 6(A), a core line of a coaxial cable 14 is connected to the first end part 111A which is a feeding point of the antenna device 30A. A shield line of the coaxial cable 14 is connected to the ground element 12 in the vicinity of the first end part 111A. Under this structure, characteristics of VSWR (Voltage Standing Wave Ratio) illustrated in FIG. 6(B) are measured. An X-axis, a Y-axis, and a Z-axis are set as illustrated in FIG. 3(A).

Furthermore, directivities (far-field radiation characteristics) illustrated in FIG. 6(C) through FIG. 6(F) are measured by a 3 m method.

As illustrated in FIG. 6(B), approximately 5.0 as the VSWR is obtained between approximately 2.4 GHz and approximately 2.5 GHz. A value equal to or less than 2.0 as the VSWR is obtained between approximately 5.0 GHz and approximately 6.0 GHz. These values indicate that reflection is little. It is found that the antenna device 30A is proper for high capacity communication between approximately 2.4 GHz and approximately 2.5 GHz and for high capacity communication at approximately 5.0 GHz.

As illustrated in FIG. 6(C), as the directivity at an X-Y surface, a value of approximately −5 dBi through approximately 0 dBi is substantially equivalently provided in each case of approximately 2.4 GHz, approximately 2.45 GHz, and approximately 2.5 GHz. Therefore, it is found that directivities at an X-Y surface at approximately 2.4 GHz, approximately 2.45 GHz, and approximately 2.5 GHz are good.

As illustrated in FIG. 6(D), as the directivity at an X-Y surface, a value of approximately 0 dBi is substantially equivalently provided in each case of approximately 5.0 GHz, approximately 5.5 GHz, and approximately 6.0 GHz. Therefore, it is found that directivities at an X-Y surface at approximately 5.0 GHz through approximately 6.0 GHz are good.

As illustrated in FIG. 6(E), as the directivity at a Y-Z surface, a value of approximately −10 dBi through approximately 0 dBi is substantially equivalently provided in each case of approximately 2.4 GHz, approximately 2.45 GHz, and approximately 2.5 GHz, excluding the vicinities of 0 degrees being a null point and 180 degrees. Therefore, it is found that directivities at a Y-Z surface at approximately 2.4 GHz through approximately 2.5 GHz are good.

As illustrated in FIG. 6(F), as the directivity at a Y-Z surface, a value of approximately −15 dBi through approximately 0 dBi is provided in each case of approximately 5.0 GHz, approximately 5.5 GHz, and approximately 6.0 GHz. Therefore, it is found that directivities at a Y-Z surface at approximately 5.0 GHz through approximately 6.0 GHz are relatively good.

As discussed above, it is found that three-dimensionally good directivities are obtained in two frequency bands, namely approximately 2.4 GHz through approximately 2.5 GHz and approximately 5.0 GHz through approximately 6.0 GHz.

Thus, it is possible to provide the antenna device 30A which can perform good communication at two frequency bands, namely approximately 2.4 GHz through approximately 2.5 GHz and approximately 5.0 GHz through approximately 6.0 GHz and which can be miniaturized.

Fourth Embodiment

FIGS. 7(A)-7(B) are views showing characteristics of an antenna device 40 of a fourth embodiment, where FIG. 7(A) is a plan view and FIG. 7(B) is an equivalent circuit diagram.

As illustrated in FIG. 7(A), the antenna device 40 of the fourth embodiment is different from the antenna device 30 of the third embodiment in that the antenna device 40 includes an antenna element 41 and a second end part 411C side and a third end part 411D side of the antenna element 41 are further bent. Since the second end part 4110 side and the third end part 411D side of the antenna element 41 are further bent, it is possible to miniaturize the entire size of the antenna device.

The antenna element 41 includes an element 411 and the stub 112.

The element 411 includes parallel parts 441 and 442 formed at heads of the bending parts 331 and 332 by being bent so as to be in parallel with a facing side 12A of the ground element 12. The second end part 411C and the third end part 411D are head ends of the parallel parts 441 and 442.

The antenna element 41 including the bending parts 331 and 332 and the parallel parts 441 and 442 is an example of a π-shaped antenna element.

In a structure other than the above-mentioned structure, parts that are the same as the parts of the antenna device 30 of the third embodiment are given the same reference numerals, and explanation thereof is omitted.

The parallel parts 441 and 442 are capacitively coupled with the ground element 12. Because of this, an equivalent circuit of the antenna device 40 is, as illustrated in FIG. 7(B), a circuit where a capacitor 440 is connected between the antenna element 41 and ground.

Since the area of the capacitor 440 is determined by the lengths of the parallel parts 441 and 442, if the lengths of the parallel parts 441 and 442 become long, capacitance of the capacitor 440 is increased.

If the capacitor 440 is inserted between the antenna element 41 and ground, the resonance frequency is shifted to the low frequency side. Therefore, in this case, it is possible to shorten the length of the line of the antenna element 41 for obtaining the same resonance frequency as that in the case where the capacitor 440 is not inserted.

Because of this, according to the antenna device 40 of the fourth embodiment, it is possible to adjust the first resonance frequency f1 by adjusting the length of the line between the first end part 111A being a feeding part and the second end part 411C, the length of the bending part 331, or the length of the parallel part 441.

Furthermore, it is possible to adjust the second resonance frequency f2 by adjusting the length of the line between the first end part 111A being a feeding part and the third end part 411D, the length of the bending part 332, or the length of the parallel part 442.

In addition, it is possible to shorten a length A in a horizontal direction of the antenna device 40 by shortening an amount corresponding to capacitance of the parallel parts 441 and 442 from the length of the line between the first end part 111A and the second end part 411C and shortening the length of the line between the first end part 111A and the third end part 411D.

In addition, it is possible to shorten the length A in a horizontal direction of the antenna device 40 by forming the bending part 331 and the parallel part 441. In addition, it is possible to shorten the length A in a horizontal direction of the antenna device 40 by forming the bending part 332 and the parallel part 442.

Bending the bending part 331 and the bending part 332 to the ground element 12 side and forming the parallel parts 441 and 442 does not cause an increase of a length B from the element 311 to the end part of the ground element 12.

Thus, according to the fourth embodiment, it is possible to easily adjust the first resonance frequency f1 and the second resonance frequency f2 and miniaturize the antenna device 40. Because of this, it is possible to provide the antenna device which can perform good communication at two frequency bands, namely approximately 2.4 GHz through approximately 2.5 GHz including the first resonance frequency f1 and approximately 5.0 GHz through approximately 6.0 GHz including the second resonance frequency f2, and possible to make the size of the antenna device 40 small.

Fifth Embodiment

Figure 8:
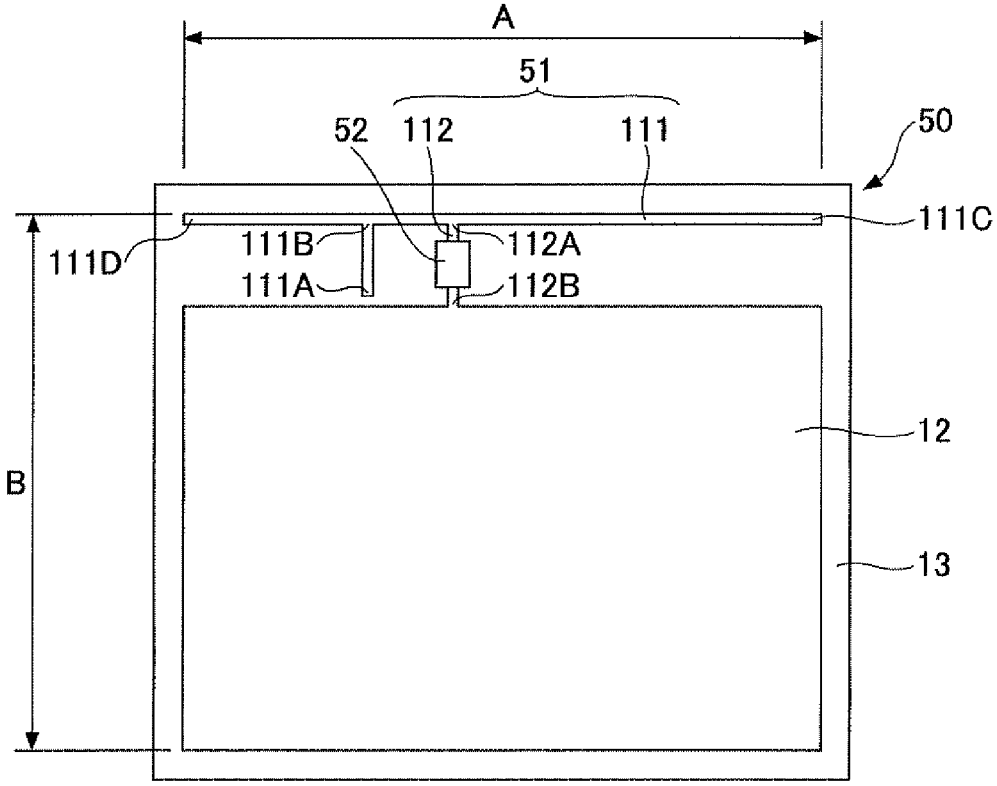
FIG. 8 is a view showing characteristics of an antenna device 50 of a fifth embodiment.

FIG. 8 is a view showing characteristics of an antenna device 50 of a fifth embodiment.

The antenna device 50 of the fifth embodiment is different from the antenna device 10 of the first embodiment, in that the inductor is inserted in the stub 112 so that the first resonance frequency f1 and the second resonance frequency f2 are adjusted in the antenna device 50.

The antenna device 50 of the fifth embodiment includes an antenna element 51 and the ground element 12. The antenna element 51 includes an element 111 and a stub 112. An inductor 52 is inserted in the stub 112.

An entire size of the antenna device 50 of the fifth embodiment is made small by inserting the inductor 52.

In a structure other than the above-mentioned structure, parts that are the same as the parts of the antenna device 10 of the first embodiment are given the same reference numerals, and explanation thereof is omitted.

The inductor 52 is an inductive element. In a case where the resonance frequency is constant, by inserting the inductive element, it is possible to make the length of the line short.

In addition, in a case where the inductance of the inductive element is large, the resonance frequency is shifted to a low frequency side. In a case where inductance of the inductive element is small, the resonance frequency is shifted to a high frequency side.

Thus, by inserting the inductor 52 to the stub 112 so that each of the inductance is adjusted, it is possible to easily adjust the first resonance frequency f1 and the second resonance frequency f2.

Since the length of the line can be shortened, the length A between the element 111 and the ground element 12 can be shortened so that the antenna device 50 can be miniaturized.

As discussed above, according to the fifth embodiment, it is possible to provide the antenna device 10 which can perform good communication at two frequency bands, namely approximately 2.4 GHz through approximately 2.5 GHz including the first resonance frequency f1 and approximately 5.0 GHz through approximately 6.0 GHz including the second resonance frequency f2, and possible to make the size of the antenna 10 small.

Sixth Embodiment

Figure 9:
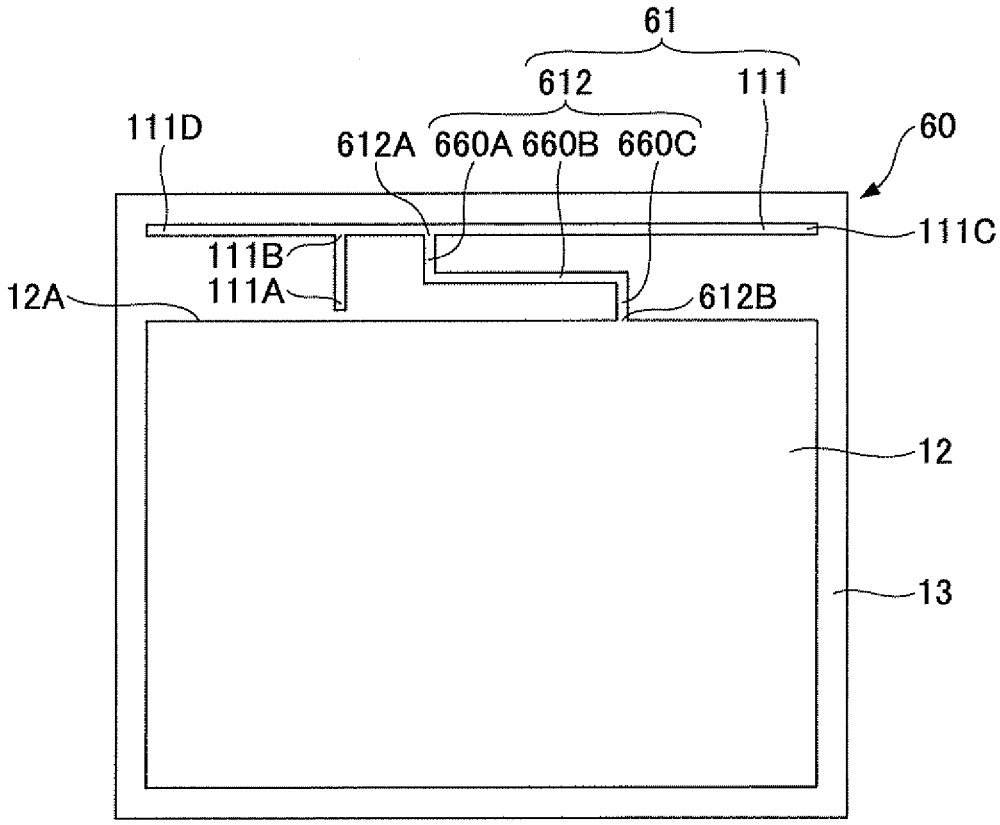
FIG. 9 is a view showing characteristics of an antenna device 60 of a sixth embodiment.
Figure 10:
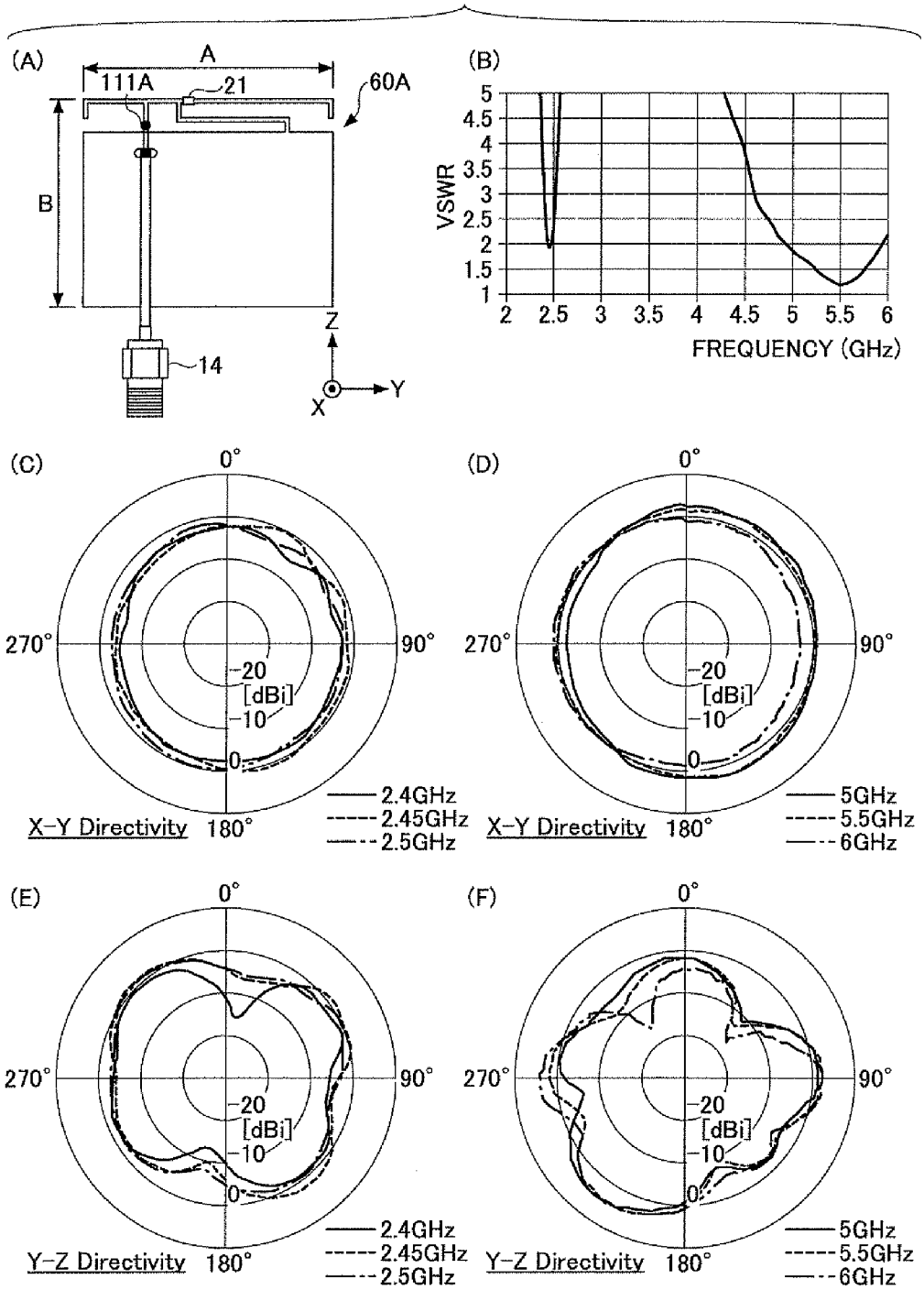
FIG. 10 is a view showing characteristics of an antenna device 60A of a first modified example of the sixth embodiment.
Figure 11:
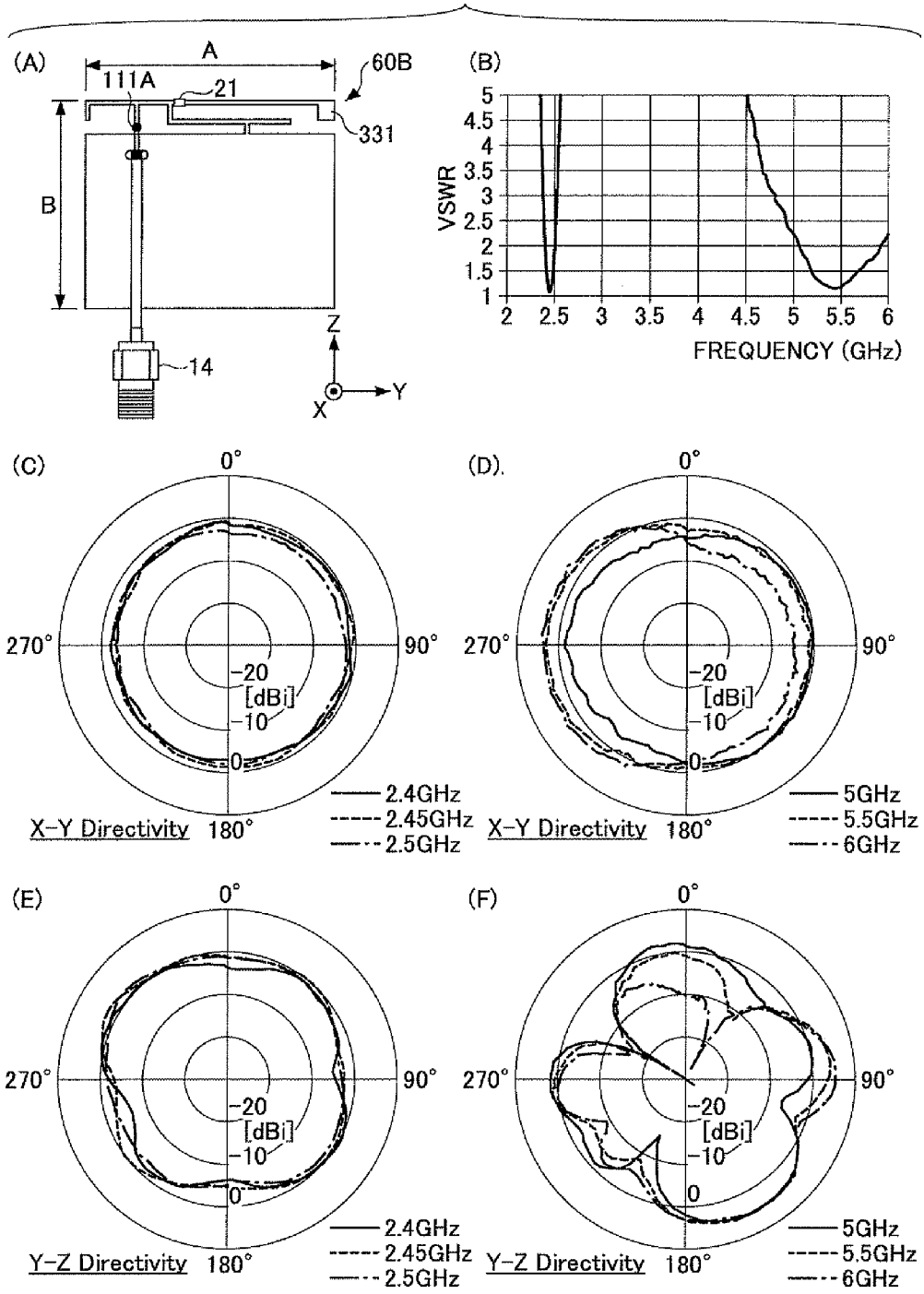
FIG. 11 is a view showing characteristics of an antenna device 60B of a second modified example of the sixth embodiment.

FIG. 9 is a view showing characteristics of an antenna device 60 of a sixth embodiment.

The antenna device 60 of the sixth embodiment is different from the antenna device 10 of the first embodiment, in that a stub 612 of an antenna element 61 of the antenna device 60 is bent.

In a structure other than the above-mentioned structure, parts that are the same as the parts of the antenna device 10 of the first embodiment are given the same reference numerals, and explanation thereof is omitted.

The antenna element 61 includes an element 111 and the stub 612.

An end 612A of the stub 612 is connected to the element 111. Another end 612B of the stub 612 is connected to the ground element 12, so that the stub 612 is grounded.

The stub 612 includes stub parts 660A, 660B, and 660C. The stub parts 660A, 660B, and 660C are connected to each other in this order so as to be bent in a crank-shaped manner.

The stub part 660A is connected to the element 111. The stub part 660B is in parallel with the second end part 1110 side of the element 111 and in parallel with the facing side 12A of the ground element 12. The stub part 660C is connected to the ground element 12.

The antenna element 61 including the bent stub 612 is an example of a π-shaped antenna element.

If the lengths of the stub parts 660A and 660C are fixed and the length of the stub part 660B is lengthened, the first resonance frequency f1, a band of approximately 2.4 GHz through approximately 2.5 GHz including the first resonance frequency f1, the second resonance frequency f2, and a band of approximately 5.0 GHz through approximately 6.0 GHz including the second resonance frequency f2, are shifted to a low frequency side.

If the lengths of the stub parts 660A and 660C are fixed and the length of the stub part 660B is shortened, the first resonance frequency f1, a band of approximately 2.4 GHz through approximately 2.5 GHz including the first resonance frequency f1, the second resonance frequency f2, and a band of approximately 5.0 GHz through approximately 6.0 GHz including the second resonance frequency f2, are shifted to a high frequency side.

If the length of the stub part 660B is fixed, the stub part 660A is lengthened, and the stub part 660C is shortened, the capacitance between the stub part 660C and the ground element 12 becomes large, so that the first resonance frequency f1 and the second resonance frequency f2 (and the bands including these resonance frequencies) are shifted to a low frequency side.

If the length of the stub part 660B is fixed, and the capacitance between the stub part 660C and the ground element 12 becomes small so that the stub part 660A is shortened and the stub part 660C is lengthened, the first resonance frequency f1 and the second resonance frequency f2 (and the bands including these resonance frequencies) are shifted to a high frequency side.

Thus, according to the antenna device 60 of the sixth embodiment, by adjusting the length between the first end part 111A and the second end part 111C of the element 111, it is possible to adjust the band of approximately 2.4 GHz through approximately 2.5 GHz including the first resonance frequency f1. By adjusting the length between the first end part 111A and the third end part 111D of the element 111, it is possible to adjust the band of approximately 5.0 GHz through approximately 6.0 GHz including the second resonance frequency f2. In addition, the first resonance frequency f1 and the second resonance frequency f2 can be adjusted by adjusting the lengths of the stub parts 660A, 660B, and 660C.

In addition, since the first resonance frequency f1 and the second resonance frequency f2 can be adjusted at the stub parts 660A, 660B, and 660C, the length between the first end part 111A and the second end part 111C and the length between the first end part 111A and the third end part 111D can be shortened. Therefore, it is possible to miniaturize the antenna device 60.

According to the sixth embodiment, it is possible to provide the antenna device 60 which can perform good communication at two frequency bands, namely approximately 2.4 GHz through approximately 2.5 GHz including the first resonance frequency f1 and approximately 5.0 GHz through approximately 6.0 GHz including the second resonance frequency f2, and possible to make the size of the antenna 60 small.

Next, characteristics of an antenna device 60A of a modified example of the sixth embodiment where the first inductor 21 of the second embodiment is added to the antenna device 60 of the sixth embodiment are discussed with reference to FIGS. 10(A)-10(F).

FIGS. 10(A)-10(F) are views showing characteristics of the antenna device 60A of a first modified example of the sixth embodiment.

As illustrated in FIG. 10(A), a core line of a coaxial cable 14 is connected to the first end part 111A which is a feeding point of the antenna device 60A. A shield line of the coaxial cable 14 is connected to the ground element 12 in the vicinity of the first end part 111A. Under this structure, characteristics of VSWR (Voltage Standing Wave Ratio) illustrated in FIG. 10(B) are measured. An X-axis, a Y-axis, and a Z-axis are set as illustrated in FIG. 10(A).

Furthermore, directivities (far-field radiation characteristics) illustrated in FIG. 10(C) through FIG. 10(F) are measured by a 3 m method.

As illustrated in FIG. 10(B), approximately 2.0 as the VSWR is obtained between approximately 2.4 GHz and approximately 2.5 GHz. A value equal to or less than 2.0 as the VSWR is obtained between approximately 5.0 GHz and approximately 6.0 GHz. These values indicate that reflection is little. It is found that the antenna device 60A is proper for high capacity communication between approximately 2.4 GHz and approximately 2.5 GHz and for high capacity communication at approximately 5.0 GHz.

As illustrated in FIG. 10(C), as the directivity at an X-Y surface, a value of approximately 0 dBi is substantially equivalently provided in each case of approximately 2.4 GHz, approximately 2.45 GHz, and approximately 2.5 GHz. Therefore, it is found that directivities at an X-Y surface at approximately 2.4 GHz, approximately 2.45 GHz, and approximately 2.5 GHz are good.

As illustrated in FIG. 10(D), as the directivity at an X-Y surface, a value of approximately 0 dBi is substantially equivalently provided in each case of approximately 5.0 GHz, approximately 5.5 GHz, and approximately 6.0 GHz. Therefore, it is found that directivities at an X-Y surface at approximately 5.0 GHz through approximately 6.0 GHz are good.

As illustrated in FIG. 10(E), as the directivity at a Y-Z surface, a value of approximately −10 dBi through approximately 0 dBi is substantially equivalently provided in each case of approximately 2.4 GHz, approximately 2.45 GHz, and approximately 2.5 GHz, excluding the vicinities of 0 degrees being a null point and 180 degrees. Therefore, it is found that directivities at a Y-Z surface at approximately 2.4 GHz through approximately 2.5 GHz are good.

As illustrated in FIG. 10(F), as the directivity at a Y-Z surface, a value of approximately −15 dBi through approximately 0 dBi is provided in each case of approximately 5.0 GHz, approximately 5.5 GHz, and approximately 6.0 GHz. Therefore, it is found that directivities at a Y-Z surface at approximately 5.0 GHz through approximately 6.0 GHz are relatively good.

As discussed above, it is found that three-dimensionally good directivities are obtained in two frequency bands, namely approximately 2.4 GHz through approximately 2.5 GHz and approximately 5.0 GHz through approximately 6.0 GHz.

Thus, it is possible to provide the antenna device 60A which can perform good communication at two frequency bands, namely approximately 2.4 GHz through approximately 2.5 GHz and approximately 5.0 GHz through approximately 6.0 GHz and which can be miniaturized.

Next, characteristics of an antenna device 60B of a second modified example of the sixth embodiment where the bending part 331 of the third embodiment is added to the antenna device 60 of the sixth embodiment are discussed with reference to FIGS. 11(A)-11(F). A width of the bending part 331 in this example is as approximately 4 times that of the bending part 331 discussed in the third embodiment.

FIGS. 11(A)-11(F) are views showing characteristics of the antenna device 60B of the second modified example of the sixth embodiment.

As illustrated in FIG. 11(A), a core line of a coaxial cable 14 is connected to the first end part 111A which is a feeding point of the antenna device 60B. A shield line of the coaxial cable 14 is connected to the ground element 12 in the vicinity of the first end part 111A. Under this structure, characteristics of VSWR (Voltage Standing Wave Ratio) illustrated in FIG. 11(B) are measured. An X-axis, a Y-axis, and a Z-axis are set as illustrated in FIG. 11(A).

Furthermore, directivities (far-field radiation characteristics) illustrated in FIG. 11(C) through FIG. 11(F) are measured by a 3 m method.

As illustrated in FIG. 11(B), a value equal to or less than approximately 1.5 as the VSWR is obtained between approximately 2.4 GHz and approximately 2.5 GHz. A minimum value is approximately 1.1. A value equal to or less than 2.0 as the VSWR is obtained between approximately 5.0 GHz and approximately 6.0 GHz. A minimum value is approximately 1.2 at approximately 5.4 GHz. These values indicate that reflection is little. It is found that the antenna device 60A is proper for high capacity communication between approximately 2.4 GHz and approximately 2.5 GHz and for high capacity communication at approximately 5.0 GHz.

As illustrated in FIG. 11(C), as the directivity at an X-Y surface, a value of approximately 0 dBi is substantially equivalently provided in each case of approximately 2.4 GHz, approximately 2.45 GHz, and approximately 2.5 GHz. Therefore, it is found that directivities at an X-Y surface at approximately 2.4 GHz, approximately 2.45 GHz, and approximately 2.5 GHz are good.

As illustrated in FIG. 11(D), as the directivity at an X-Y surface, a value of approximately 0 dBi is substantially equivalently provided in each case of approximately 5.0 GHz, approximately 5.5 GHz, and approximately 6.0 GHz. Therefore, it is found that directivities at an X-Y surface at approximately 5.0 GHz through approximately 6.0 GHz are good.

As illustrated in FIG. 11(E), as the directivity at a Y-Z surface, a value of approximately −5 dBi through approximately 0 dBi is substantially equivalently provided in each case of approximately 2.4 GHz, approximately 2.45 GHz, and approximately 2.5 GHz, excluding the vicinities of 0 degrees being a null point and 180 degrees. Therefore, it is found that directivities at a Y-Z surface at approximately 2.4 GHz through approximately 2.5 GHz are good.

As illustrated in FIG. 11(F), as the directivity at a Y-Z surface, a value of approximately −15 dBi through approximately 0 dBi is provided in each case of approximately 5.0 GHz, approximately 5.5 GHz, and approximately 6.0 GHz. Therefore, it is found that directivities at a Y-Z surface at approximately 5.0 GHz through approximately 6.0 GHz are relatively good.

As discussed above, it is found that three-dimensionally good directivities are obtained in two frequency bands, namely approximately 2.4 GHz through approximately 2.5 GHz and approximately 5.0 GHz through approximately 6.0 GHz.

Thus, it is possible to provide the antenna device 60B which can perform good communication at two frequency bands, namely approximately 2.4 GHz through approximately 2.5 GHz and approximately 5.0 GHz through approximately 6.0 GHz and which can be miniaturized.

Seventh Embodiment

Figure 12:
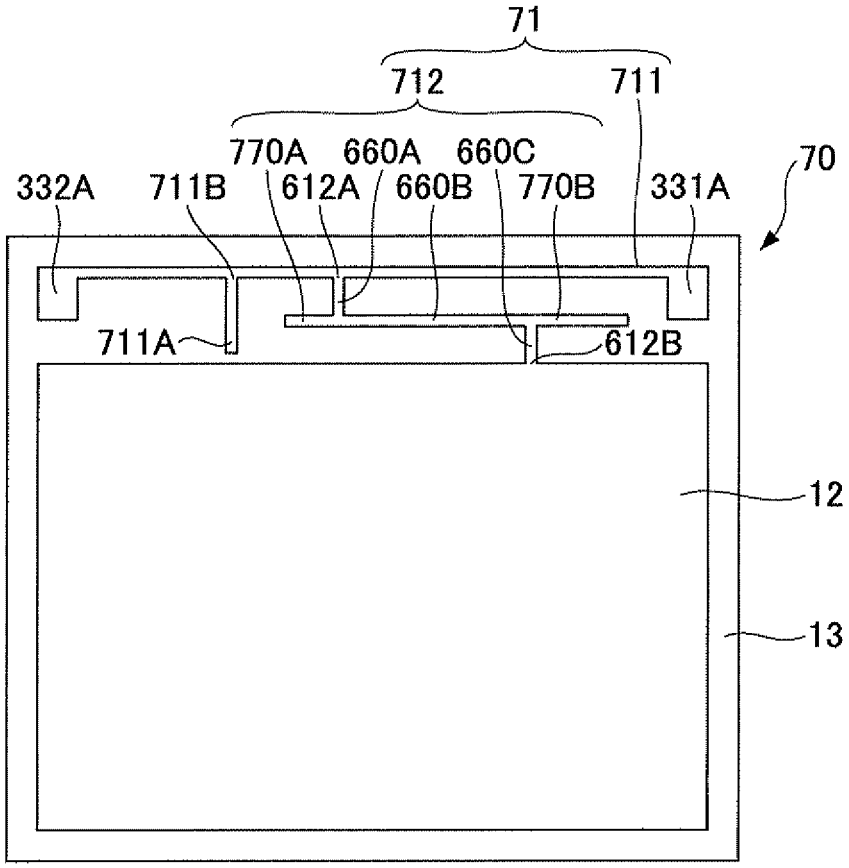
FIG. 12 is a plan view showing an antenna device 70 of a seventh embodiment.

FIG. 12 is a plan view showing an antenna device 70 of a seventh embodiment.

An antenna device 70 of the seventh embodiment is different from the antenna device 60 of the sixth embodiment, in that in the antenna device 70, a stub 712 of an antenna element 71 includes stub parts 770A and 770B in addition to the stub parts 660A, 660B, and 660C; and a second end part 711C side and a third end part 711D side of an element 711 include respective bending parts 331A and 332A bent to the ground element 12 side. The widths of the bending parts 331A and 332A are four times those of the bending parts 331 and 332 of the third embodiment.

In a structure other than the above-mentioned structure, parts that are the same as the parts of the antenna device 60 of the sixth embodiment are given the same reference numerals, and explanation thereof is omitted.

The antenna device 70 includes the antenna element 71 and the ground element 12. The antenna element 71 includes an element 711 and the stub 712.

The stub 712 includes the stub parts 770A and 770B in addition to the stub parts 660A, 660B, and 660C.

An end 612A of the stub 712 is connected to the element 711. Another end 612E of the stub 712 is connected to the ground element 12, so that the ground element 12 is grounded.

The stub 712 includes the stub parts 660A, 660B, and 660C. The stub parts 660A and 660C of this embodiment are the same as the stub parts 660A and 660C of the sixth embodiment. The stub part 660E of this embodiment extends in a longitudinal direction so that the stub part 660B projects at parts connecting to the stub parts 660A and 660C. Portions of the stub part 660B, the portions projecting more than the parts connecting to the stub parts 660A and 660B, are the stub parts 770A and 770B.

The antenna element 71 including the bent stub 712 is an example of a π-shaped antenna element.

If the lengths of the stub parts 660A and 660C are fixed and the length of the stub parts 770A and 770E are lengthened, the first resonance frequency f1, a band of approximately 2.4 GHz through approximately 2.5 GHz including the first resonance frequency f1, the second resonance frequency f2, and a band of approximately 5.0 GHz through approximately 6.0 GHz including the second resonance frequency f2, are shifted to a low frequency side. If the lengths of the stub parts 660A and 660C are fixed and the length of the stub parts 770A and 770B are shortened, the first resonance frequency f1, a band of approximately 2.4 GHz through approximately 2.5 GHz including the first resonance frequency f1, the second resonance frequency f2, and a band of approximately 5.0 GHz through approximately 6.0 GHz including the second resonance frequency f2, are shifted to a high frequency side.

If the length of the stub part 660B is fixed and the stub part 660A is shifted to the intermediate point 711B side (left side in FIG. 12) by shortening the amount of the stub part 770A, the first resonance frequency f1 and the second resonance frequency f2 (and the bands including these resonance frequencies) are shifted to a low frequency side. On the other hand, if the length of the stub part 660B is fixed and the stub part 660A is shifted to the bending part 331A side (right side in FIG. 12) by lengthening the amount of the stub part 770A, the first resonance frequency f1 and the second resonance frequency f2 (and the bands including these resonance frequencies) are shifted to a high frequency side.

If the length of the stub part 660B is fixed and the stub part 660C is shifted to the intermediate point 711B side (left side in FIG. 12) by lengthening the amount of the stub part 770B, the first resonance frequency f1 and the second resonance frequency f2 (and the bands including these resonance frequencies) are shifted to a high frequency side. On the other hand, if the length of the stub part 660B is fixed and the stub part 660C is shifted to the bending part 331A side (right side in FIG. 12) by shortening the amount of the stub part 770B, the first resonance frequency f1 and the second resonance frequency f2 (and the bands including these resonance frequencies) are shifted to a low frequency side.

If the width of the bending part 331A is made thick, the first resonance frequency f1 (and a band including f1) are shifted to a low frequency side. In this case, the second resonance frequency f2 (and a band including f2) is not much changed. This is because the stub 712 is connected to the ground element 12.

If the width of the bending part 331B is made thick, the second resonance frequency f2 (and a band including f2) are shifted to a low frequency side. In this case, the first resonance frequency f1 (and a band including f1) is not much changed. This is because the stub 712 is connected to the ground element 12.

Thus, according to the antenna device 70 of the seventh embodiment, the first resonance frequency f1 and the second resonance frequency f2 can be adjusted by adjusting the lengths of the stub parts 660A, 660B, 660C, 770A and 770B, the positions of the stub parts 660A and 660C, and the widths of the bending parts 331A and 331B. Because of this, it is possible to easily adjust the first resonance frequency f1 and the second resonance frequency f2.

Since the first resonance frequency f1 can be adjusted by the stub parts 660A, 660B, 660C, 770A and 770B and the bending part 331A, the length between the first end part 711A and the second end part 711C of the element 711 can be shortened.

Similarly, since the second resonance frequency f2 can be adjusted by bending part 331B, the length between the first end part 711A and the third end part 711D of the element 711 can be shortened.

Therefore, it is possible to miniaturize the antenna device 70.

According to the seventh embodiment, it is possible to provide the antenna device 70 which can perform good communication at two frequency bands, namely approximately 2.4 GHz through approximately 2.5 GHz including the first resonance frequency f1 and approximately 5.0 GHz through approximately 6.0 GHz including the second resonance frequency f2, and possible to make the size of the antenna 70 small.

Eighth Embodiment

Figure 13:
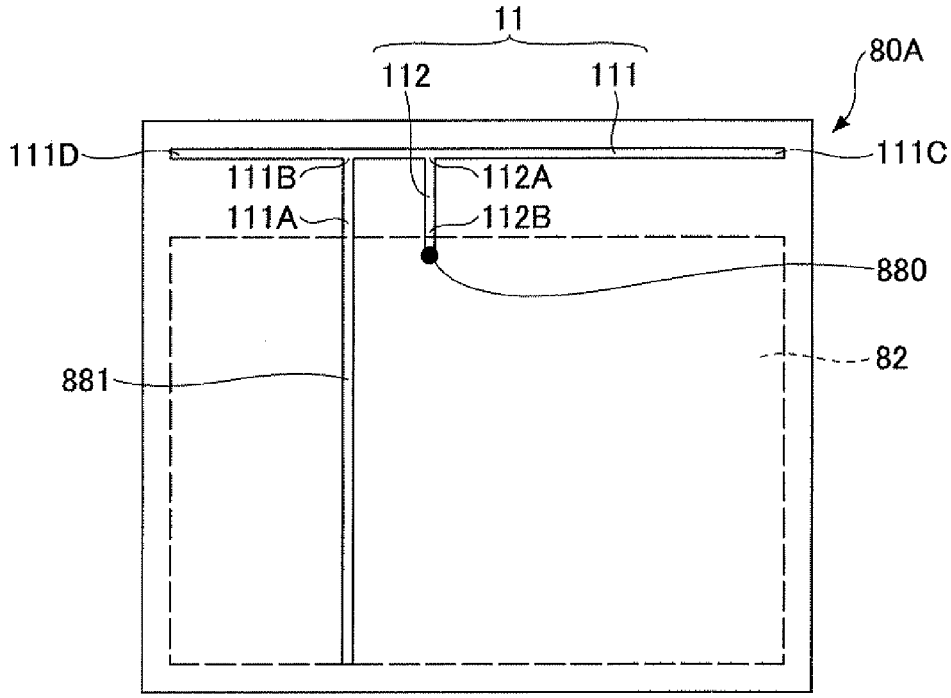
FIG. 13 is a plan view showing an antenna device 80A of an eighth embodiment.

FIG. 13 is a plan view showing an antenna device 80A of an eighth embodiment.

The antenna device 80A of the eighth embodiment is different from the antenna device 10 of the first embodiment, in that in the antenna device 80A, the ground element 82 is formed at the rear surface side of the board 13; another end 112B of the stub 112 is connected to the ground element 82 via a via-hole 880, and a microstrip line 811 is connected to the first end part 111A of the element 111 of the first embodiment.

In a structure other than the above-mentioned structure, parts that are the same as the parts of the antenna device 10 of the first embodiment are given the same reference numerals, and explanation thereof is omitted.

Since electric power loss is not generated in the microstrip line 811, the antenna device 80A illustrated in FIG. 13 is equivalent to the antenna device 10 of the first embodiment.

Because of this, it is possible to provide the antenna device 80A which can perform good communication at two frequency bands, namely approximately 2.4 GHz through approximately 2.5 GHz including the first resonance frequency f1 and approximately 5.0 GHz through approximately 6.0 GHz including the second resonance frequency f2.

In addition, the ground element 82 may be formed in the vicinity of the microstrip line 881.

Figure 14:
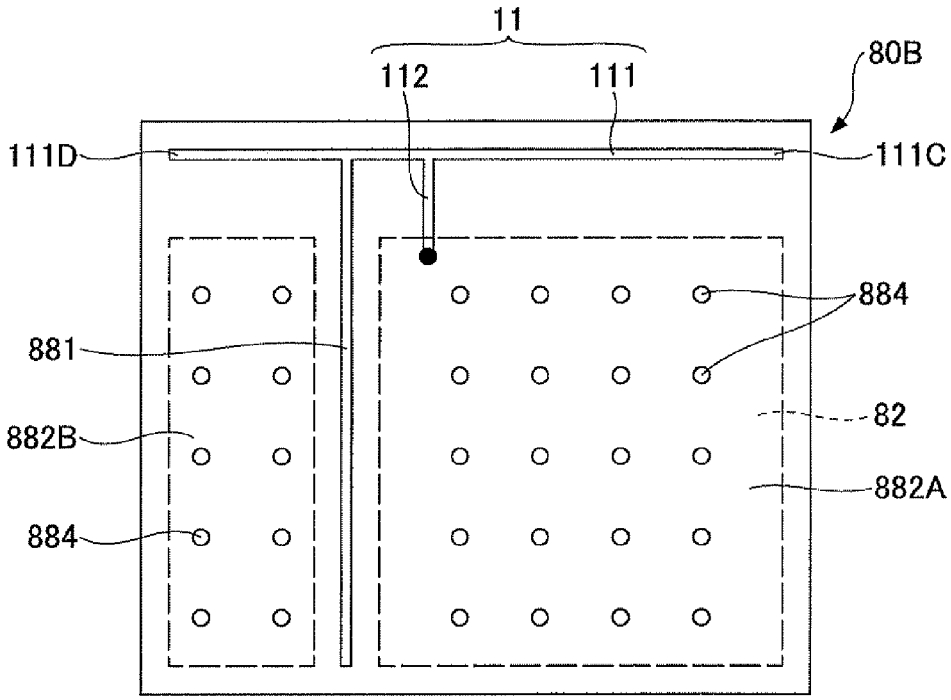
FIG. 14 is a plan view showing an antenna device 80B of a modified example of the eighth embodiment.
Figure 15:
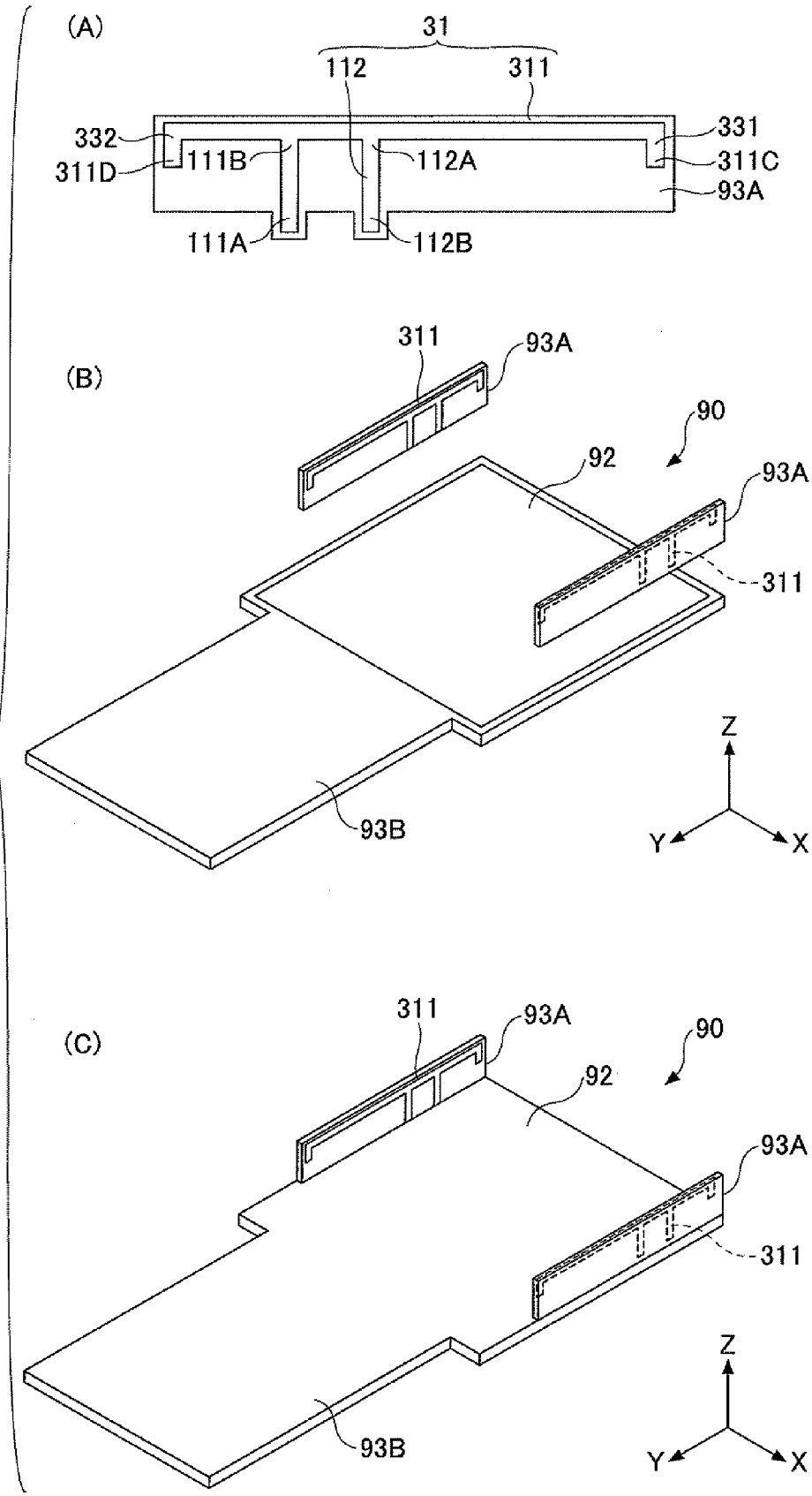
FIG. 15 is a plan view showing an antenna device 90 of a ninth embodiment.

FIG. 14 is a plan view showing an antenna device 80B of a modified example of the eighth embodiment.

The antenna device 80B is different from the antenna device 80A illustrated in FIG. 13 in that the antenna device 80B includes ground elements 882A and 882B provided one on each side of the microstrip line 881. The ground elements 882A and 882B are connected to, via via-holes 884, the ground element 82 provided at the rear surface. The ground elements 882A and 882B are separated from the microstrip line 881 so that transmission of electric power at the microstrip line 881 is not influenced.

Thus, in the antenna device 80B including the ground elements 882A and 882E provided one on each side of the microstrip line 881, good communication can be performed at two frequency bands, namely approximately 2.4 GHz through approximately 2.5 GHz including the first resonance frequency f1 and approximately 5.0 GHz through approximately 6.0 GHz including the second resonance frequency f2. Only one of the ground elements 882A and 882B may be provided.

Thus, according to the eighth embodiment, it is possible to provide the antenna devices 80A and 80B which can perform good communication at two frequency bands, namely approximately 2.4 GHz through approximately 2.5 GHz including the first resonance frequency f1 and approximately 5.0 GHz through approximately 6.0 GHz including the second resonance frequency f2.

Ninth Embodiment

FIG. 15(A) is a plan view showing an antenna device 90 of a ninth embodiment; FIG. 15(B) is an exploded perspective view; and FIG. 15(C) is a perspective view.

The antenna device 90 of the ninth embodiment has a changed structure compared to the structure of the antenna device 30 of the third embodiment.

In a structure other than the above-mentioned structure, parts that are the same as the parts of the antenna device 30 of the third embodiment are given the same reference numerals, and explanation thereof is omitted.

As illustrated in FIG. 15(A), an antenna element 31 is provided on a board 93A. The antenna element 31 includes an element 311 and a stub 112. The element 311 includes bending parts 331 and 332 formed by being bent to form a second end part 311C side and a third end part 311D side.

As illustrated in FIGS. 15(B) and FIG. 15(C), the board 93A where the antenna element 31 is formed is provided so as to stand perpendicular against a board 93B. A pair of the boards 93A is provided at the board 93B. More specifically, the pair of the boards 93A is provided at the board 93B so that the antenna elements 31 formed at the boards 93A face each other.

A ground element 92 is formed at the board 93B and the other end 112E of the stub 112 is connected to the ground element 92.

In the antenna device 90 of the ninth embodiment, since the antenna element 31 stands against the ground element 92, equivalent directivity at the X-Y surface is secured so that good communication can be achieved.

Thus, according to the ninth embodiment, it is possible to provide the antenna device 90 which can perform good communication at two frequency bands, namely approximately 2.4 GHz through approximately 2.5 GHz including the first resonance frequency f1 and approximately 5.0 GHz through approximately 6.0 GHz including the second resonance frequency f2.

Tenth Embodiment

Figure 16:
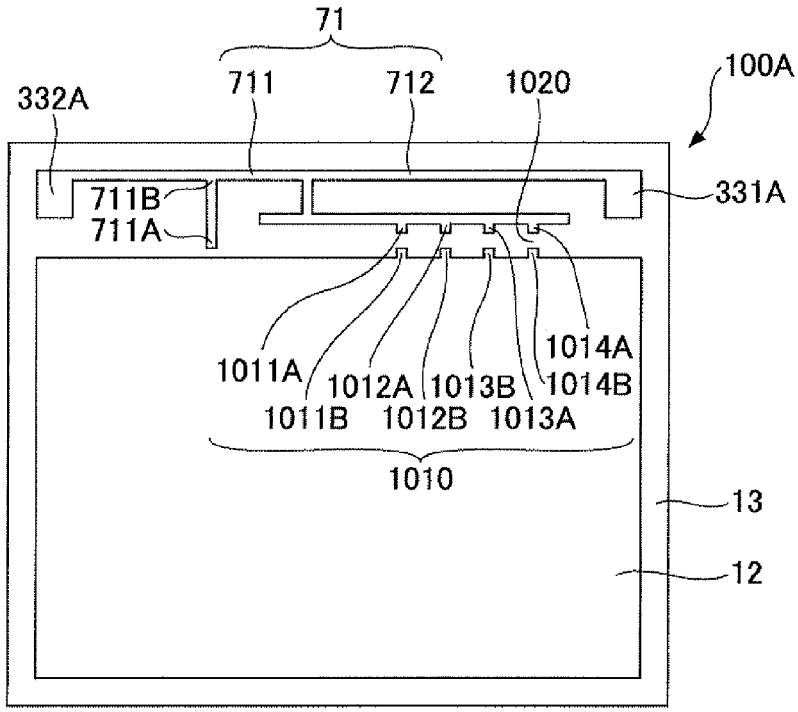
FIG. 16 is a plan view showing an antenna device 100A of a tenth embodiment.

FIG. 16 is a plan view showing an antenna device 100A of a tenth embodiment.

The antenna device 100A of the tenth embodiment has a structure where a position of the stub part 660C of the antenna device 70 of the seventh embodiment can be adjusted by the user.

In a structure other than the above-mentioned structure, parts that are the same as the parts of the antenna device 70 of the seventh embodiment are given the same reference numerals, and explanation thereof is omitted.

As illustrated in FIG. 16, the antenna device 100A includes the antenna element 71 and the ground element 12. The antenna element 71 includes the element 711 and the stub 712.

The stub 712 includes the stub parts 660A, 660B, 770A, 770B and a stub part 1010. The stub part 1010 includes four pairs of connecting parts 1011A, 1011B, 1012A, 1012B, 1013A, 1013B, 1014A, and 1014B. Four pairs means a pair of the connecting parts 1011A and 1011B, a pair of the connecting parts 1012A and 1012B, a pair of the connecting parts 1013A and 1013B, and a pair of the connecting parts 1014A and 1014B.

The corresponding connecting parts 1011A and 1011B, 1012A and 1012B, 1013A and 1013B, 1014A and 1014B may be connected to each other by jumper lines 1020. As the jumper line 1020, for example, a 0 (zero) ohms resistance line can be used.

FIG. 16 shows a state where the connecting parts 1014A and 1014B are connected to each other by the jumper line 1020.

Thus, by connecting any pairs of the connecting parts 1011R and 1011B, 1012A and 1012B, 1013A and 1013B, 1014A and 1014B by the jumper lines 1020, the user of the antenna device 100A can adjust the first resonance frequency f1 and the second resonance frequency f2. Especially, the frequency band including the first resonance frequency f1 has sharper (steeper) characteristics than the frequency band including the second resonance frequency f2. Therefore, the change of the characteristics based on the fine adjustment of the frequency band area may be easily generated. Hence, the structure of the antenna device 100A where the first resonance frequency f1 and the second resonance frequency f2 can be adjusted can realize good communication and is effective.

Next, an antenna device 100B which is a modified example of the antenna device 100A is discussed with reference to FIG. 17.

Figure 17:
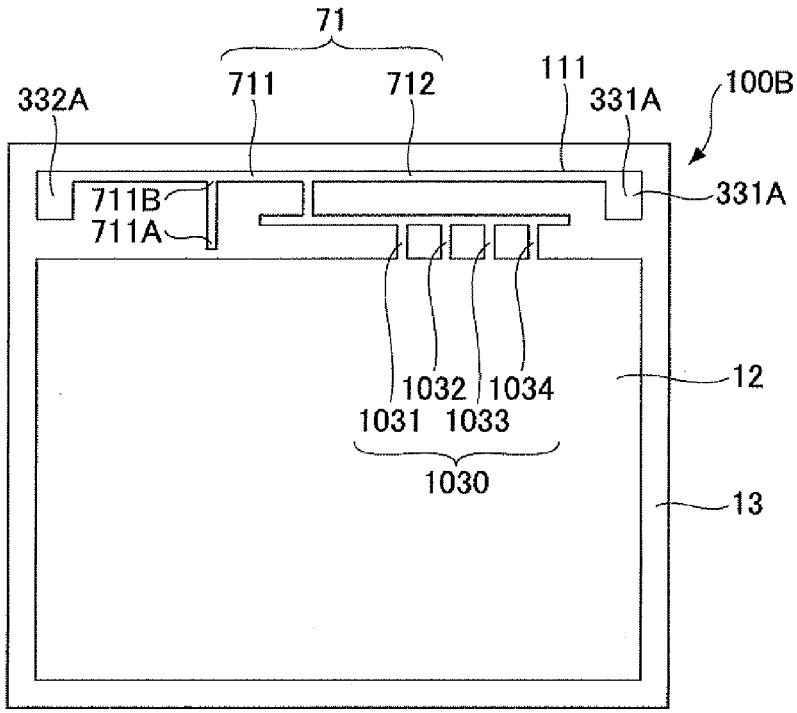
FIG. 17 is a plan view showing an antenna device 100B of a modified example of the tenth embodiment.

FIG. 17 is a plan view showing the antenna device 100B of a modified example of the tenth embodiment.

The antenna device 100B has a structure where the stub part 1010 of the antenna device 100A is replaced with a stub part 1030.

In a structure other than the above-mentioned structure, parts that are the same as the parts of the antenna device 100A are given the same reference numerals, and explanation thereof is omitted.

The stub part 1030 of the antenna device 100B includes four stub parts 1031, 1032, 1033, and 1034.

The user of the antenna device 100B, as well as the antenna device 100A, can adjust the first resonance frequency f1 and the second resonance frequency f2 by, for example, irradiating a laser light so as to cut any of the stub parts 1031, 1032, 1033, and 1034.

Thus, according to the tenth embodiment, it is possible to provide the antenna devices 100A and 100B which can perform good communication at two frequency bands, namely approximately 2.4 GHz through approximately 2.5 GHz including the first resonance frequency f1 and approximately 5.0 GHz through approximately 6.0 GHz including the second resonance frequency f2.

Eleventh Embodiment

Figure 18:
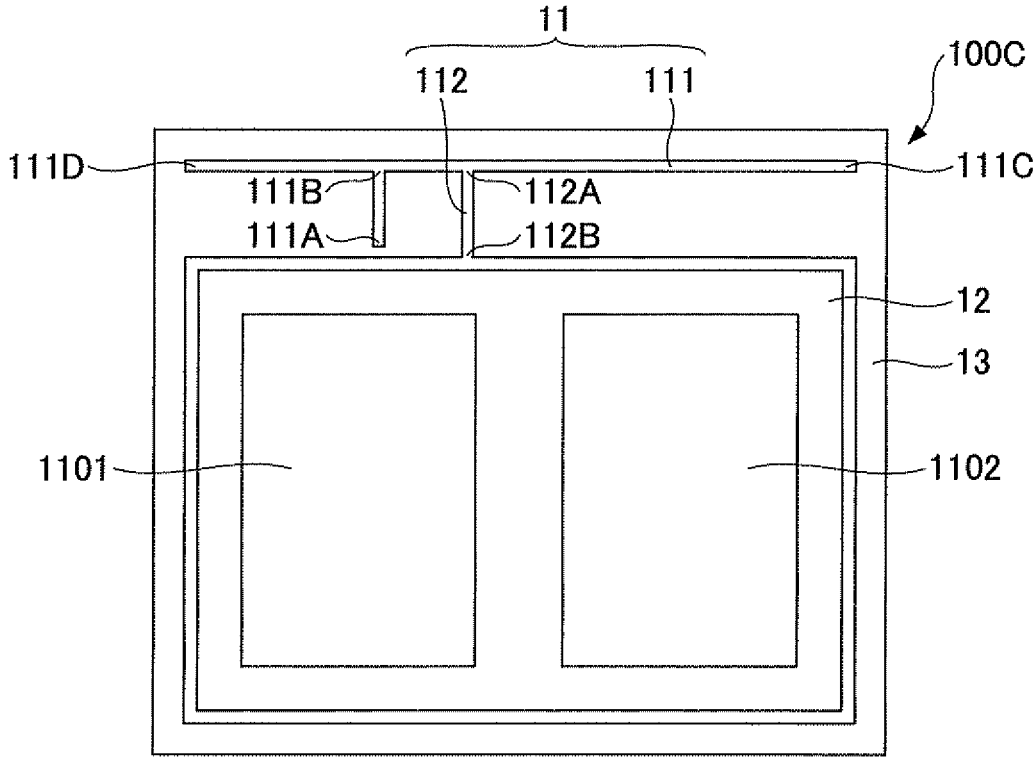
FIG. 18 is a plan view showing an antenna device 100C of an eleventh embodiment.

FIG. 18 is a plan view showing an antenna device 100C of an eleventh embodiment.

The antenna device 100C of the eleventh embodiment has a structure where communication circuits 1101 and 1102 are provided at the ground element 12 of the antenna device 10 of the first embodiment.

In a structure other than the above-mentioned structure, parts that are the same as the parts of the antenna device 10 of the first embodiment are given the same reference numerals, and explanation thereof is omitted.

Thus, although the communication circuits 1101 and 1102 are provided at the ground element 12, in the antenna device 100C as well as the antenna device 10 of the first embodiment, good communication can be performed at two frequency bands, namely approximately 2.4 GHz through approximately 2.5 GHz including the first resonance frequency f1 and approximately 5.0 GHz through approximately 6.0 GHz including the second resonance frequency f2.

Thus, according to the eleventh embodiment, it is possible to provide the antenna device 100C which can perform good communication at two frequency bands, namely approximately 2.4 GHz through approximately 2.5 GHz including the first resonance frequency f1 and approximately 5.0 GHz through approximately 6.0 GHz including the second resonance frequency f2.

According to the embodiments of the present invention, it is possible to provide an antenna device whereby plural resonance frequencies can be easily adjusted.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. An antenna device, comprising:

a T-shaped element having a first end part, a second end part, and a third end part, the first end part being a feeding point, the T-shaped element being bifurcated at an intermediate point located between the second and third end parts; and a stub having one end connected between the intermediate point and the second end point and another end connected to ground, the stub forming a n-shaped configuration with the T-shaped element;

wherein a length of a first line between the first end part and the second end part is longer than a length of a second line between the first end part and the third end part;

the length of the first line and the length of the second line correspond to a first resonance frequency and a second resonance frequency, and a first band including the first resonance frequency and a second band including the second resonance frequency are adjusted based on a position of an antenna element of the T-shaped element to which the stub is connected, wherein the T-shaped element includes a first bending part at a head end of each of the second and third end parts, wherein the T-shaped element further includes another bending part provided at a head end of the bending part, and wherein a second bending part is formed by bending a head end of the first bending part in a direction parallel to the T-shaped element between the first bending parts.

2. The antenna device as claimed in claim 1, further comprising:

an inductive element provided between the intermediate point and the second end part or between the intermediate point and the third end part.

3. The antenna device as claimed in claim 1, further comprising:

a capacitive element or an inductive element inserted in the stub.

4. The antenna device as claimed in claim 1, wherein the stub is bent at a single part or plural parts.

5. The antenna device as claimed in claim 4, wherein the stub is bent so that the one end, compared to the other end, is positioned near the second end part.

6. The antenna device as claimed in claim 4, wherein the bent part of the stub further includes another stub.

7. The antenna device as claimed in claim 1, further comprising:

a ground part formed on a same surface of a board where the T-shaped element and the stub are formed, wherein the other end of the stub is connected to the ground part so that the stub is grounded.

8. The antenna device as claimed in claim 1, further comprising:

a ground part formed on another surface opposite to a surface of a board where the T-shaped element and the stub are formed, wherein the antenna device includes a microstrip line provided at a side of the first end part, the microstrip line overlapping the ground part.

9. The planar antenna device as claimed in claim 1, wherein a length between the first end and second end is equal to the width of the ground element.

10. A antenna device, comprising:

a T-shaped element having a first end part, a second end part, and a third end part, the first end part being a feeding point, the T-shaped element being bifurcated at an intermediate point located between the second and third end parts; and a stub having one end connected between the intermediate point and the second end point and another end connected to ground, the stub forming a n-shaped configuration with the T-shaped element;

wherein a length of a first line between the first end part and the second end part is longer than a length of a second line between the first end part and the third end part;

the length of the first line and the length of the second line correspond to a first resonance frequency and a second resonance frequency, a first band including the first resonance frequency and a second band including the second resonance frequency are adjusted based on a position of an antenna element of the T-shaped element to which the stub is connected, wherein the T-shaped element includes a first bending part at a head end of each of the second and third end parts, and wherein a width of the first bending part at the head end of said each of the second and third end parts is greater than a width of the T-shaped element.

11. A planar antenna device, comprising:

a substrate;

a T-shaped element formed on the substrate, said T-shaped element including a first element having a first end part and a second end part, and a second element having a third end part and a fourth end part, the first end part being a feeding point and the second end being connected to the second element at an intermediate point between the third and fourth end parts;

a ground element formed on the substrate; and a stub formed on the substrate, the stub having one end connected to the second element at a position between the intermediate point and the fourth end part and the other end of the stub being connected to the ground element;

wherein a first line length between the fourth end part of the second element and the second end part is longer than a second line length between the third end part of the second element and the second end part;

the first line length and the second line length correspond to a first resonance frequency and a second resonance frequency, respectively, a first band including the first resonance frequency and a second band including the second resonance frequency are adjusted based on a position of the second element to which the stub is connected, and the T-shaped element includes a first bending part at a head end of each of the third and fourth end parts, and wherein the T-shaped element further includes another bending part provided at a head end of the bending part, and wherein a second bending part is formed by bending a head end of the first bending part in a direction parallel to the T-shaped element between the first bending parts.

* * * * *